US005082756A

United States Patent [19]

Doi

[11] Patent Number: 5,082,756

[45] Date of Patent: Jan. 21, 1992

[54] PHOTOSENSITIVE MEMBER FOR RETAINING ELECTROSTATIC LATENT IMAGES

[75] Inventor: Isao Doi, Osaka, Japan

[73] Assignee: Minolta Camera Kabushiki Kaisha, Osaka, Japan

[21] Appl. No.: 480,560

[22] Filed: Feb. 15, 1990

[30] Foreign Application Priority Data

Feb. 16, 1989 [JP] Japan ..... 1-037177
Jul. 27, 1989 [JP] Japan ..... 1-197096

[51] Int. Cl.[5] ..... G03G 5/147
[52] U.S. Cl. ..... 430/67; 430/66
[58] Field of Search ..... 430/66, 67

[56] References Cited

U.S. PATENT DOCUMENTS 3,306,160 2/1967 Dinhobel et al. ..... 430/67 X
3,607,258 9/1971 Hoegl et al. ..... 430/67
3,627,526 12/1971 Donald ..... 430/66
3,653,890 4/1972 Seimiya et al. ..... 430/67 X
3,730,710 5/1973 Ohta ..... 430/66 X
3,973,958 8/1976 Bean ..... 430/66 X
4,634,648 1/1987 Jansen et al. ..... 430/84
4,687,722 8/1987 Ogawa ..... 430/59
4,696,883 9/1987 Saitoh et al. ..... 430/57
4,740,440 4/1988 Honda et al. ..... 430/60

FOREIGN PATENT DOCUMENTS 745570 11/1966 Canada ..... 430/66
1295 2/1963 Japan ..... 430/67

*Primary Examiner*—Roland Martin
*Attorney, Agent, or Firm*—Burns, Doane, Swecker & Mathis

[57] ABSTRACT

This invention relates to a photosensitive member for retaining electrostatic latent images, which comprises:
an electrically conductive substrate,
a photosensitive layer formed on the electrically conductive layer and including a photoconductive material, and
insulating and light-transmittable specks distributed on the photosensitive layer as a surface protective layer.

30 Claims, 8 Drawing Sheets

PHOTOSENSITIVE MEMBER FOR RETAINING ELECTROSTATIC LATENT IMAGES

BACKGROUND OF THE INVENTION

The present invention relates to a photosensitive member having a surface protective layer, and more particularly to a photosensitive member having specks as a surface protective layer.

There are proposed various photosensitive layers composed of inorganic photoconductive substances such as selenium or organic photoconductive substances for use in electrophotographic photosensitive members. In general photosensitive layers having low hardness tend to be abraded or scratched by the friction with transfer papers, cleaning members, developers and the like during repeated copying operations.

From the above mentioned problem, there is proposed to provide a surface protective layer for a photosensitive member having insufficient hardness.

There are known amorphous silicon photosensitive layers excellent in hardness and abrasion resistance. However, it is to be noted that surface protective layers are also provided on the amorphous silicon photosensitive members to improve the surface characteristics.

Furthermore, when coherent monochromatic light such as a laser beam is employed as a light source for exposure to form electrostatic latent images, there may occur a problem that each light reflected from the uppermost surface of a photosensitive member, from each interface between the respective layers constituting the photosensitive member, and from the interface between the substrate and the photosensitive layer may interfere with one another. The longer the wavelength of the laser beam is, the more remarkable the interference phenomenon is, because the adsorption of the laser beam into the photosensitive layer is decreased.

Still furthermore, with respect to the thickness of the photosensitive member or of the respective layers constituting the photosensitive member, irregularities of such a degree as submicron (which corresponds to the wavelength of laser beams) are formed inevitably by any conventional layer-forming method.

Accordingly, the interference phenomena and the uneveness in the thickness of the photosensitive member inevitably cause interference fringes in the copied images formed on the photosensitive member, resulting in poor image reproduction.

This problem can not be solved merely by forming a surface protective layer on the photosensitive member.

SUMMARY OF THE INVENTION

The object of the present invention is therefore to provide a photosensitive member provided with a surface protective layer which effectively eliminates interference fringes without causing deterioration in resolving power or other disadvantages.

Another object of the present invention is to provide a photosensitive member which is improved in humidity resistance for long time use, and does not cause blurs and flows in the copied images even when used repeatedly under a high humidity atmosphere.

Still further object of the present invention is to provide a photosensitive member which is excellent in durability and hardness for a long time.

This invention relates to a photosensitive member for retaining electrostatic latent images, which comprises:

an electrically conductive substrate, a photosensitive layer formed on the electrically conductive substrate and including a photoconductive material, and insulating and light-transmittable specks distributed on the photosensitive layer as s surface protective layer.

DETAILED DESCRIPTION OF THE INVENTION

The present invention relates to a photosensitive member for retaining electrostatic latent images, which comprises:

an electrically conductive substrate, a photosensitive layer formed on the electrically conductive substrate and including a photoconductive material, and insulating and light-transmittable specks distributed on the photosensitive layer as s surface protective layer.

Specks forming a surface protective layer according to the present invention may be of any shape, and may be distributed on the photosensitive layer either regularly or irregularly, but predetermined limitations must be given to the thickness, the width of the specks and to the intervals therebetween. In addition, it is preferable that the specks are distributed on the photosensitive member so that the exposure areas of the photosensitive layer may not be arranged in parallel with or perpendicular to the direction of the edge of a cleaning blade.

FIGS. 7 to 10 are plan views of the surface protective layers of photosensitive members of the present invention.

Figure 7:
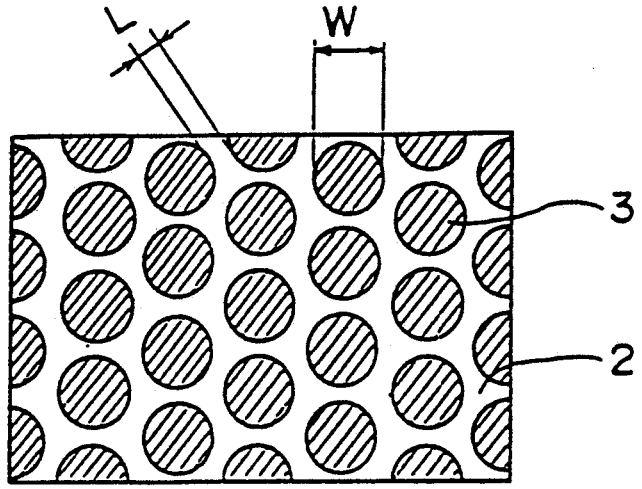
FIGS. 7 to 10 are plan views of the surfaces of photosensitive members.

Referring to FIG. 7, each circle of the shaded portions indicates one of specks and serves as the surface protective layer as a whole, and other portion is the surface of a photosensitive layer (2) or a resinous layer (4). This is the same in the case of FIGS. 8 to 10. In FIG. 7, the surface protective layer is composed of circle specks (3) which are arranged regularly on the photosensitive layer, and an alphabetic symbol "W" represents the maximal width of the speck (3), and an alphabetic symbol "L" represents the nearest distance between each of specks adjacent to each other.

Figure 8:
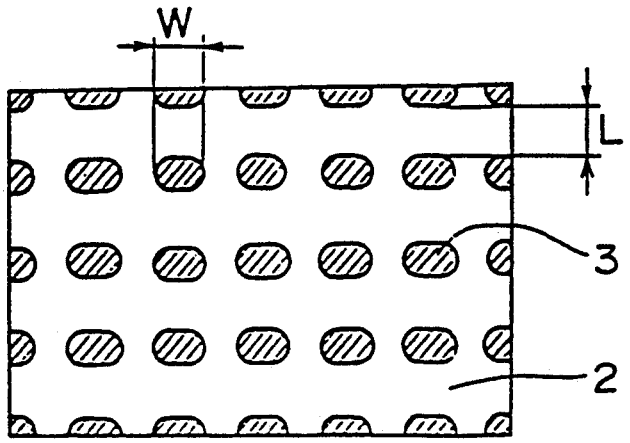

FIG. 8 shows a surface protective layer composed of oval specks (3) arranged regularly on a photosensitive layer.

Figure 9:
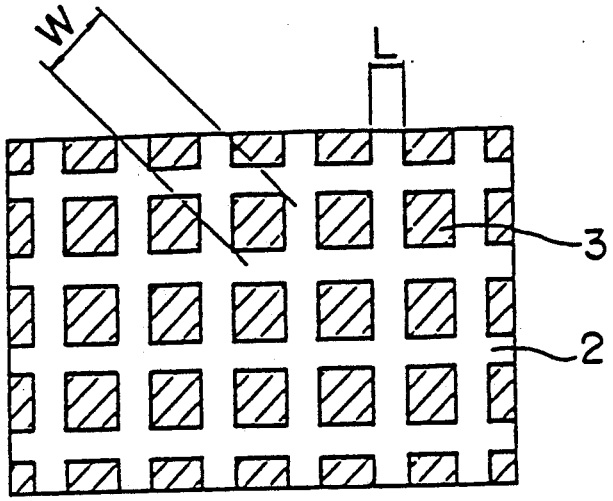

FIG. 9 shows a surface protective layer composed of square specks (3) arranged regularly on a photosensitive layer.

Figure 10:
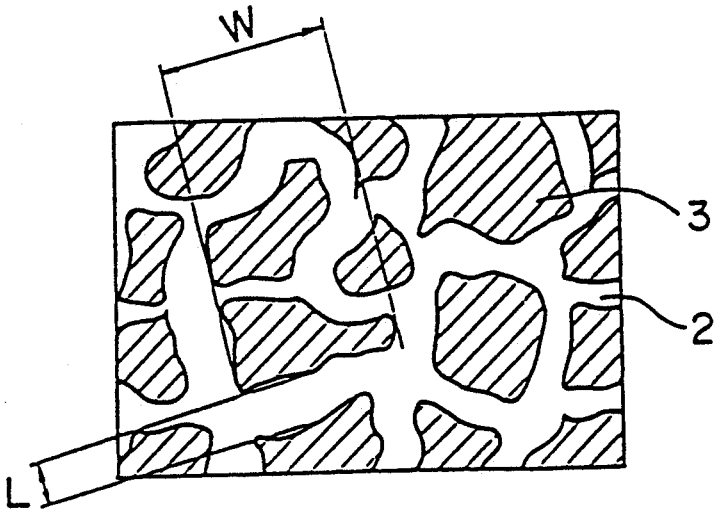

FIG. 10 shows a surface protective layer composed of specks (3) which have not a specified shape and being distributed at random on the photosensitive layer. The maximal width W of each speck (3) and the nearest distance L between each of the specks adjacent to each other may be varied, but they are required to be respectively within a predetermined range.

In the present invention the respective specks may be of any shape, and distributed in any manner, but limited in the maximal width W to 200 μm or less, preferably to 120 μm or less, and more preferably to 80 μm or less. If it is greater than 200 μm, the photosensitive member can not be improved in humidity resistance, which is one of the objects of the present invention, and there arises a disadvantage that the resolving power of the copied images deteriorates. There is provided no limitation in the lower limit of the maximal width of each speck, but it may be preferably about 1 μm or more.

The nearest distance L between each of the specks adjacent to each other is 200 μm or less, preferably 60 μm or less, and more preferably 25 μm or less. If it is greater than 200 μm, the exposure portion of the photosensitive layer becomes too large, and tends to be worn and abraded, so that the specks may not serve as a surface protective layer.

More preferably, the ratio L/W of the nearest distance L to the maximal width W of the speck is 1 or less, preferably 0.5 or less, and more preferably 0.3 or less. If the ratio is more than 1, in other words, if the nearest distance is too large in proportion to the maximal width of the speck, the exposure areas increases, leading to the wear and the abrasion of the photosensitive layer, and further to the crack and abrasion in the edges of the respective specks.

When specks are formed so that the maximal width of the speck, and the nearest distance between them may be specified to the above mentioned values, the specks function to protect the surface of the photosensitive layer, and also effectively prevent interference phenomena.

Figure 1:
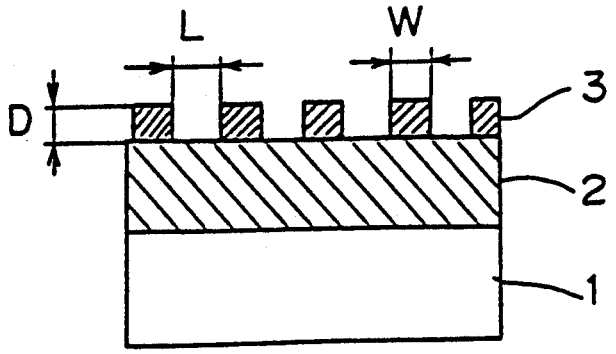
FIGS. 1 to 6 are schematic cross sectional views of photosensitive members of the present invention.

FIGS. 1 to 6 are the cross sectional views of photosensitive members. Referring to FIG. 1, the numeral (1) is an electrically conductive substrate, the numeral (2) is a photosensitive layer, and the numeral (3) is a speck serving as a surface protective layer. The cross sectional view shown in FIG. 1 is of a photosensitive member in which uniform specks shown in any of FIGS. 7 to 9 are arranged in order as shown in any of FIGS. 7 to 9. An alphabetic symbol D is the thickness of the speck.

Figure 2:
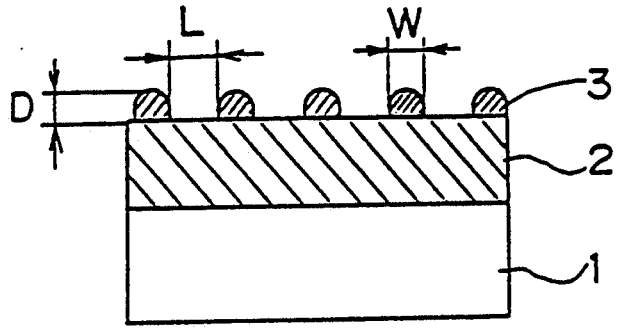

FIG. 2 is a cross sectional view of a photosensitive member in which the edge of a speck is chamferred.

Figure 3:
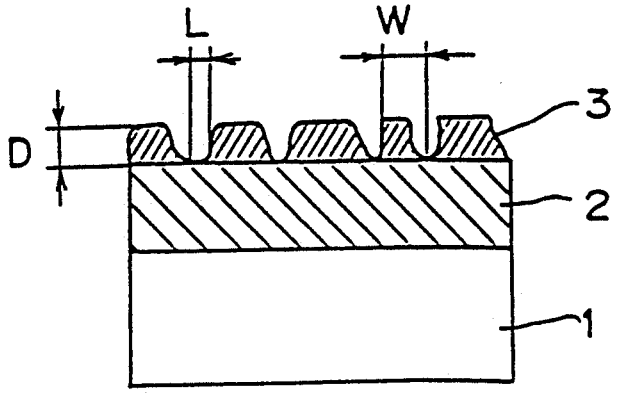
Figure 13:
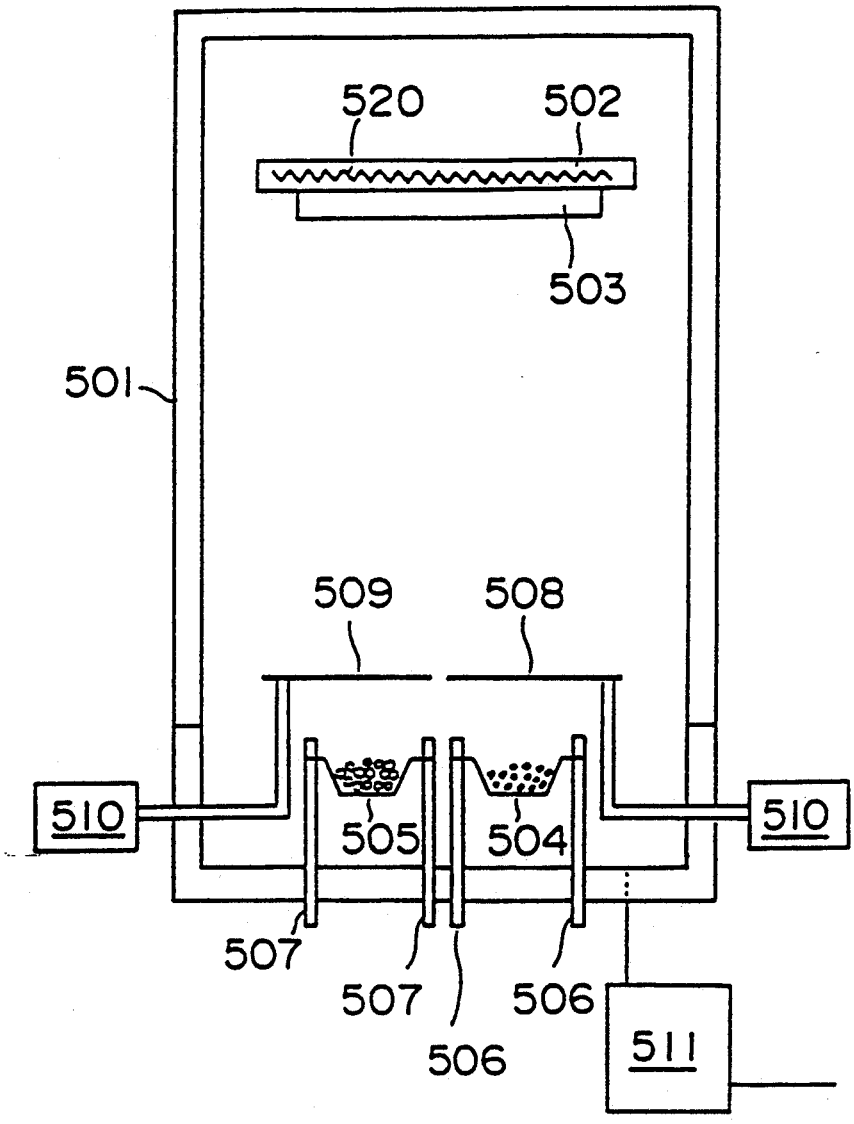
FIGS. 13 and 14 are schematic constitutional views of vapor deposition apparatuses used for forming surface protective layers.

FIG. 3 is a schematic cross sectional view of a photosensitive member in which specks having not specified shapes are arranged in disorder to serve as a surface protective layer as shown in FIG. 10. In FIG. 13, an alphabetic symbol D is the thickness of the speck.

Figure 4:
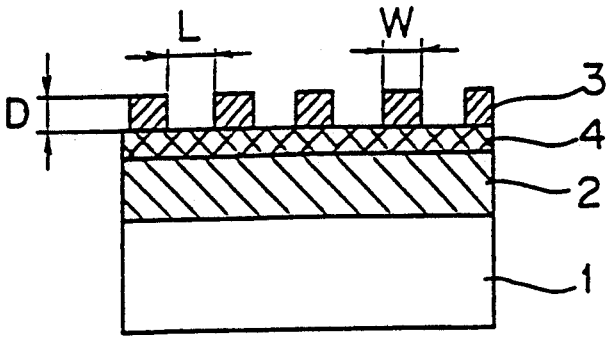
Figure 5:
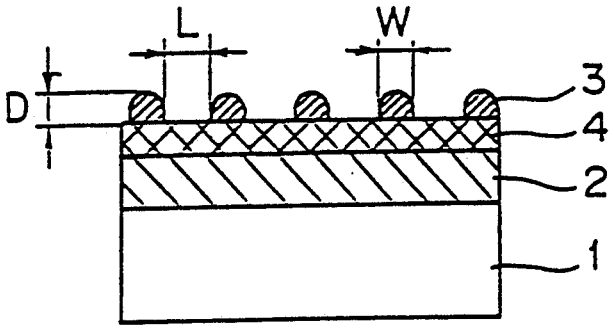
Figure 6:
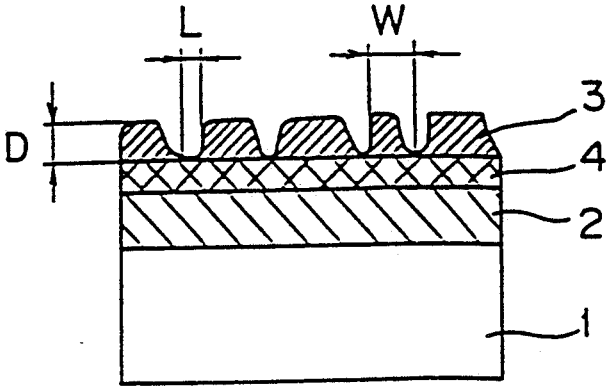

FIGS. 4 to 6 shows photosensitive members in which photosensitive layers (2), resinous layers (4), surface protective layers (3) are laminated in this order on electrically conductive substrates.

The photosensitive member shown in FIG. 4 has the same surface protective layer as that of the photosensitive member shown in FIG. 1, and the photosensitive member shown in FIG. 5 has the same surface protective layer as that of the photosensitive member shown in FIG. 2, and the photosensitive member shown in FIG. 6 has the same surface protective layer as that of the photosensitive member shown in FIG. 3.

In the present invention, the thickness D of the surface protective layer is from 0.01 to 5 μm, preferably 0.04 to 1 μm, and more preferably 0.08 to 0.5 μm. If the thickness D is more than 5 μm, the toner-cleaning function of the copying machine declines, the sensitivity of the photosensitive member deteriorates because of the deterioration of the light transmittance property, the residual electrical potential is increased, the layer forming property deteriorates and the layer adhesion becomes poor. If the thickness D is less than 0.01 μm, the strength of the surface protective layer is decreased, which causes flaws and abrasion thereon.

When the surface of the photosensitive member is notably uneven, toner particles on the photosensitive member may not be removed completely therefrom. It is to be noted that so far as surface protective layers are formed by a plasma polymerization technique according to the present invention, toner cleaning-failures do not occur.

A photosensitive layer formed underneath the surface protective layer may be the one per se known, which is conventionally provided on an electrically conductive substrate. The internal structure of the photosensitive layer may be a single-layer type structure, or a laminated type structure in which a charge generating layer and a charge transporting layer are formed on the electrically conductive substrate in this order or in the reverse order.

When a photosensitive layer, which is soft or poor in hardness, but excellent in humidity resistance and/or ozone resistance is provided, the humidity resistance after long time use and the blurs and flows observed in copied images when used repeatedly under a high humidity atmosphere are improved effectively in combination with the surface protective layer of the present invention. These effects come from the technique in which specks, serving as a surface protective layer, are distributed on or over the photosensitive layer so that the respective specks are surrounded by the areas of the photosensitive layer having a poor hydrophilic property, thereby improving the humidity resistance after durability tests with respect to copy.

For example, an amorphous hydrocarbon layer covering all over the surface of an organic photosensitive member shows poor humidity resistance after the durability test with respect to copy. This is why during copying process in which a charging process and an exposing process are repeated, the weak interatomic bonds formed on or in the layer are dissociated by a corona discharge or the like, and moisture in the atmosphere is adsorbed to the dissociation portions, so that the surface electrical resistance of the layer is lowered. It has been found that a copying process is repeated about 100,000 times, the flows of the copied images occur under the high humidity atmosphere of 80% at the temperature of 35° C.

It is known that most of the surfaces of organic photosensitive members are composed of a polymer having little weak interatomic bonds, and do not show hydrophilic property in practical use even if exposed to corona discharge for a long time.

Accordingly, the isolation of each specks composed of amorphous hydrocarbon on the surface of the photosensitive layer effects the prevention of the lowering of the surface electrical resistance of the surface protective layer. Thus, the specks prevent the photosensitive layer from deteriorating in humidity resistance after the durability test with respect to copy.

Photosensitive layers excellent in humidity resistance and/or ozone resistance are exemplified by organic photosensitive layers; selenium type photosensitive layers such as the ones of single layer types of an alloy of selenium and arsenic or laminated layer types of a selenium layer and an alloy layer of selenium and arsenic deposited in this order; the ones of resinous types in which various photoconductive substances are dispersed in resins; the one in which resinous layers are provided on photosensitive layers, and the like.

In the case where a resin layer is provided on a photosensitive layer, the present invention may be also applied to a photosensitive layer having high hardness such as an a-si photosensitive layer or the like.

Surface protective layers constituted of specks on photosensitive layers can improve the hardness and durability of the photosensitive layers. Such examples are amorphous hydrocarbon layers, amorphous silicon layers, amorphous silicon carbide layers, formed by a plasma polymerization method, and metallic compound layers obtained from metallic compounds by a vapor deposition technique. The metallic compounds include metal oxides such as $Al_2O_3$, $Bi_2O_3$, $Ce_2O_3$, $Cr_2O_3$, $In_2O_3$, MgO, SiO, $SiO_2$, $SnO_2$, $Ta_2O_5$, TiO, $TiO_2$, $ZrO_2$, $Y_2O_3$, and the like; metallic nitride such as $Si_3N_4$, $Ta_2N$, and the like; metallic fluoride such as $MgF_2$, LiF, $NdF_3$, $LaF_3$, $CaF_2$, $CeF_3$, and the like; metallic carbide such as SiC, TiC and the like; metallic sulfide such as ZnS, CdS, PbS and the like. Among these metallic compounds, preferable are $Al_2O_3$, MgO, SiO, $SiO_2$, TiO, $TiO_2$, $SnO_2$, $Si_3N_4$, $MgF_2$, SiC and the like. It is more preferable that the above mentioned speck-distribution type surface protective layer has a specific resistance of $10^{10}$ Ω cm or more so as to ensure stability in chargeability and image density.

The resinous layer formed underneath the surface protective layer may be formed from the known resins having ozone resistance and humidity resistance by a conventional technique. Examples of such resins include thermoplastic resins, thermosetting resins, photosetting resins, and the like. More particular examples are thermoplastic resins such as polyester resins, polyamide resins, polybutadienes, acrylic resins, ethylene-vinyl acetate copolymers, ion-crosslinked olefin copolymers (ionomers), styrene-butadiene block copolymers, polycarbonate resins, vinyl chloride-vinyl acetate copolymers, cellulose esters, polyimides and the like; thermosetting resins such as epoxy resins, urethane resins, silicon resins, phenolic resins, melamine resins, xylene resins, alkyd resins and the like; and photoconductive resins such as poly-N-vinylcarbazoles, polyvinylpyrenes, polyvinylanthracenes and the like. Among these resins, preferable are silicon resins, acrylic resins, melamine resins, polycarbonate resins, polybutadienes, epoxy resins and the like.

The resinous layer (4) is formed as follows: a solution prepared by dissolving any of the above mentioned resins in an adequate solvent is applied to the surface of the photosensitive layer (2), and dried so that the resultant thickness of a resinous layer may be about 0.01 to 5 μm, preferably 0.05 to 2 μm, more preferably 0.1 to 1 μm. If the thickness of the resinous layer (4) is less than 0.01 μm, a resultant photosensitive member can not be effectively improved in humidity resistance in case where the photosensitive layer is a hard photosensitive member such as an amorphous silicon or the like. If the thickness is more than 5 μm, the increase of the residual potential becomes notable, and the sensitivity is lowered because of the poor light transmittance.

The resinous solution is applied to the photosensitive layer by known methods, such as a spraying method, a dipping method, a bar-coater coating method or the like. Beside these methods, resinous layers may be formed by a vacuum deposition process or a sputtering process.

Resinous layers may contain fine particles of electrically conductive metallic compounds dispersed therein.

The fine particles of the electrically conductive metallic compound are preferably $10^9$ Ω.cm or less in electrical resistance, and 0.3 μm or less, more preferably, 0.1 μm or less in diameter, and colored in white, grey or bluish white. Particular examples are indium oxide, tin oxide, titanium oxide, antimony oxide, a solid solution of tin oxide and antimony, a solid solution of tin oxide and antimony oxide, magnesium fluoride, silicon carbide, a mixture thereof and the like.

In the photosensitive member of the present invention, in order to form distributed specks of amorphous hydrocarbon layers or metallic compound layers, the substrate is tightly covered with a sheet, a film, or mesh having pores corresponding to desired shapes of specks, and then subjected to a glow discharge plasma treatment or a vapor deposition treatment. Particular limitation is not given to the materials of the sheets and the films, but in the case where the substrate is cylindrical, it is convenient to use stretchable tubular films, sheets or meshes. Heat-shrinkable substances may be also available.

The heat-shrinkable substances includes polyethylenes, polyolefins, crosslinking polyolefins, polyvinyl chlorides, crosslinking polyethylenes, saturated polyesters, radiation crosslinking nylons, polyamide elastomers, fluorine resin PFA, silicon rubbers, radiation crosslinking modified silicon, low-density polyethylenes, tetrafluoroethylene resins and the like. Among these, in the case of organic photosensitive layers, polyolefins, crosslinking polyolefins, polyvinyl chlorides and low-density polyethylenes are preferable in view of heat resistance, in the case of organic photosensitive layers.

Preferably, surface protective layers are formed by a glow discharge plasma process: gaseous molecules comprising carbon atoms and hydrogen atoms are subjected to the glow discharge treatment under reduced pressure, and the active neutral seeds or charged seeds generated in the plasma atmosphere are diffused on the substrate, then collected by the aid of electricity or magnetism, and deposited as solid substances on the substrate through the recombination reaction, thereby forming a surface protective layer thereon. Thus, through what is called plasma reaction, an amorphous carbon layer can be formed.

The above mentioned molecules are not always gaseous at a normal temperature under normal pressure, but may be either liquid or solid, only if they can be volatilized through dissolution, vaporization, and sublimation when heated or decompressed. The examples of the molecules comprising carbon atoms or hydrogen atoms are hydrocarbons such as saturated hydrocarbons, such as methane, ethane, propane, butane, and the like; unsaturated hydrocarbons, such as ethylene, propylene, butadiene and the like; alicyclic hydrocarbons, such as cyclohexane, cycloheptane and the like; aromatic hydrocarbon, such as benzene, toluene, styrene, and the like.

Particularly, compounds having unsaturated bonds, which are excellent in reactivity, are preferable to obtain high quality layers. Butadiene, propylene and the like are particularly preferred in terms of layer-forming properties, handling properties in the gaseous state, safety and cost-effectiveness.

The characteristics of amorphous hydrocarbon layers may be controlled by replacing a part of the atoms in the layer with halogen. Elements of IIIA group and VA group in the periodic table may be incorporated therein. Other atoms may be incorporated if desired.

Amorphous hydrocarbon layers are hard in essence and having a pencil hardness of 4H or more. The incorporation of halogen atoms effects the formation of harder surface protective layers excellent in resistance to damages, chargeability and light transmittance properties.

Halogen atoms may be contained in the surface protective layer so that they may be distributed uniformly or ununiformly along the thickness direction.

Molecules containing at least halogen atoms employed in the present invention are not always gaseous at a normal temperature under normal pressure, but may be either liquid or solid, if they can be volatilized through dissolution, vaporization, and sublimation when heated or decompressed.

The molecules containing halogen atoms are exemplified by compounds such as fluorine, chlorine, bromine, iodine, hydrogen fluoride, chlorine fluoride, bromine fluoride, iodine fluoride, hydrogen chloride, bromine chloride, iodine chloride, hydrogen bromide, iodine bromide, hydrogen iodide, and the like; and organic compounds such as halogenated alkyl, halogenated aryl, halogenated styrene, halogenated polymethylene, haloform, halogen-substituted hydrocarbon and the like.

Among these molecules, preferable are tetrafluorocarbon perfluoroethylene, perfluoropropylene, and the like in terms of layer-forming properties, handling properties and safety in the gaseous state, and cost-effectiveness.

The content of the halogen atoms contained in the amorphous hydrocarbon layer may be controlled by increasing or decreasing the amount of the halogen atom-containing molecules used for P-CVD reaction.

Particular limitation is not given to the content of hydrogen atoms contained in the amorphous carbon layer, however it is inevitably limited to about 5 to about 50 atomic %, when the structure of a surface protective layer and the producing technique thereof utilizing glow discharge treatment are taken into consideration.

The contents of carbon atoms, hydrogen atoms, halogen atoms and the like contained in the amorphous hydrocarbon layer may be detected from the organic elementary analysis, Auger analysis, SIMS analysis or the like.

Figure 11:
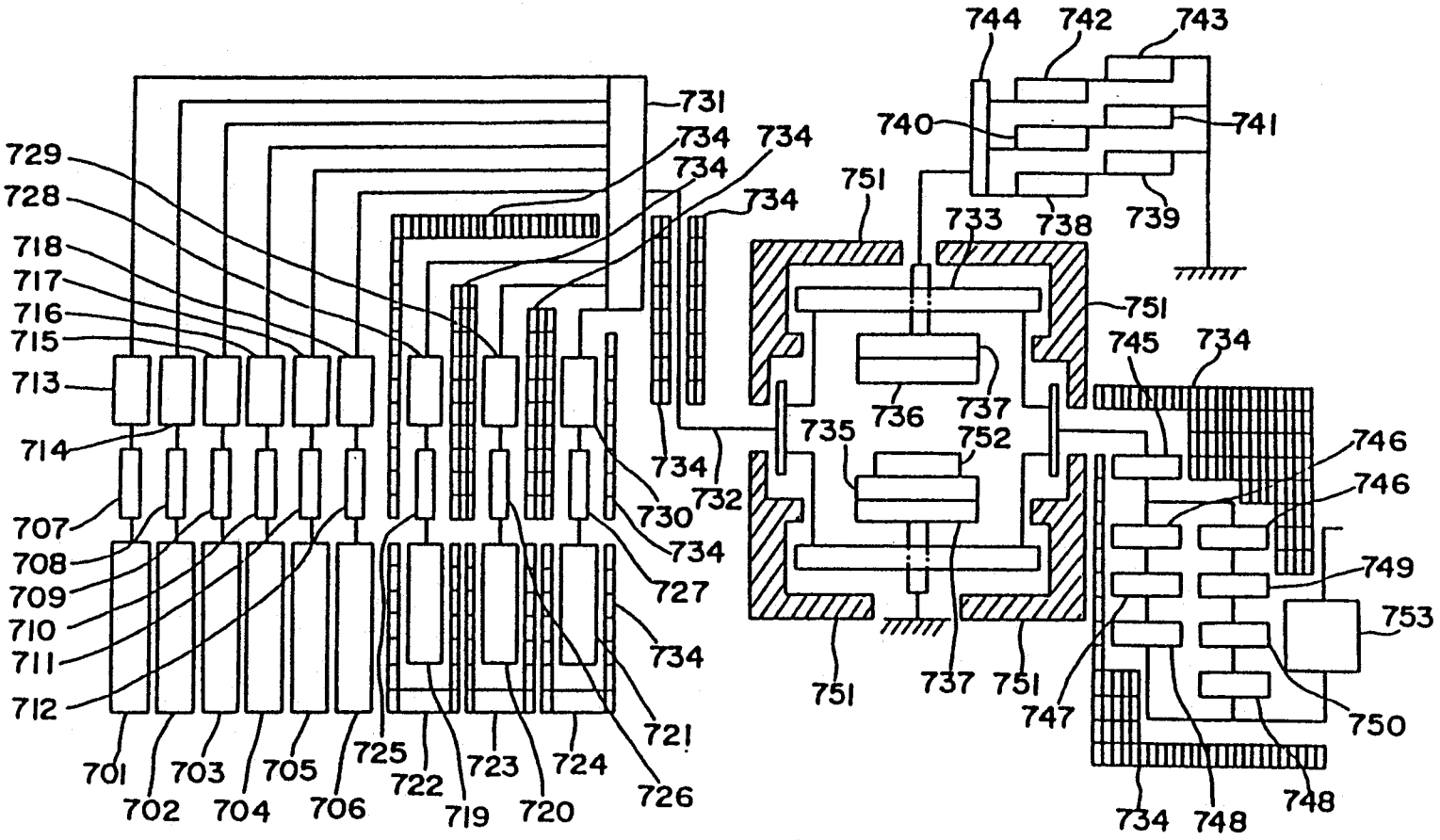
FIGS. 11 and 12 are schematic constitutional views of glow discharge decomposition apparatuses used for forming surface protective layers.
Figure 12:
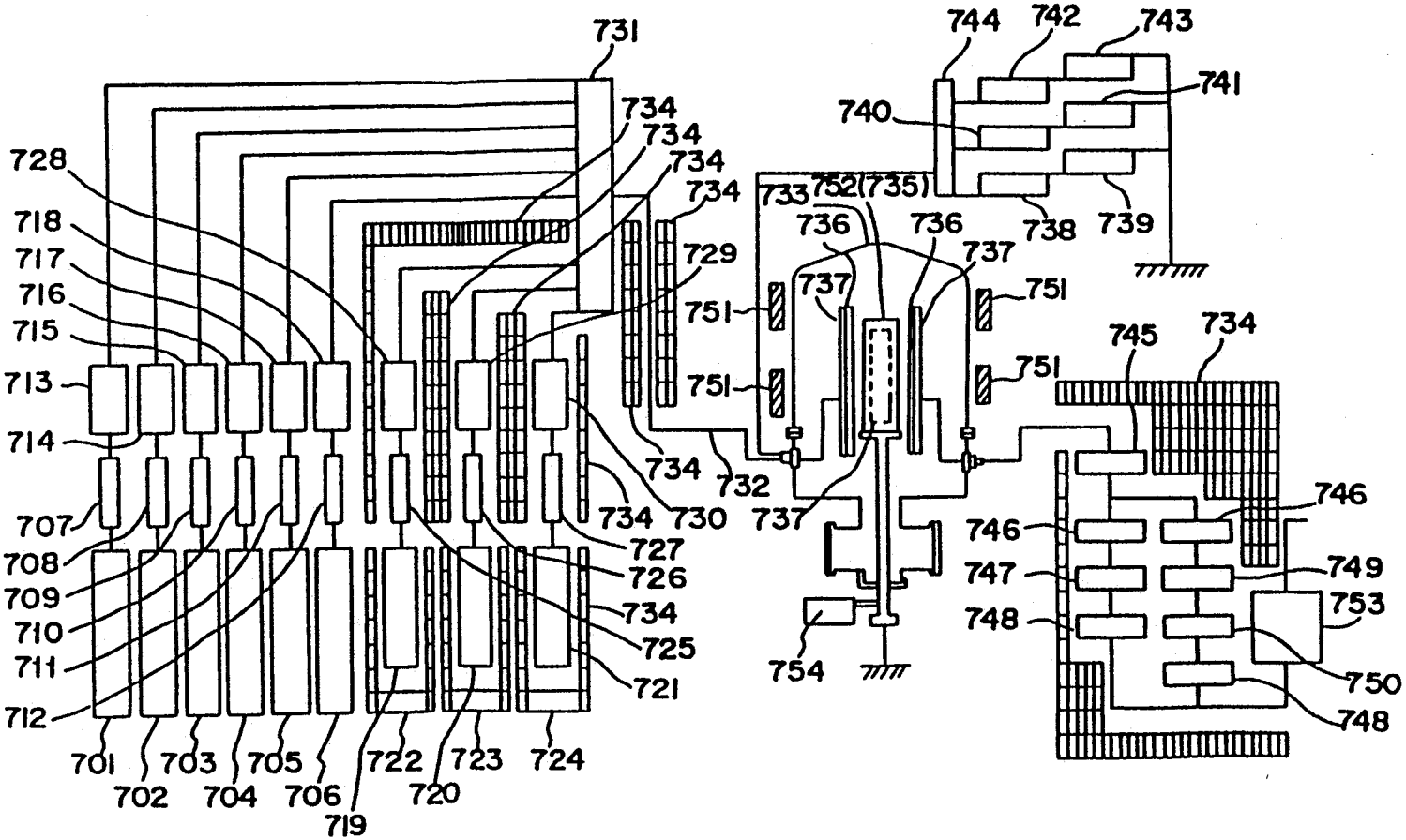

FIGS. 11 and 12 show the examples of glow discharge decomposition equipment for forming surface protective layers according to the present invention. FIG. 11 shows a parallel plate type P-CVD equipment, and FIG. 12 shows a cylindrical type P-CVD equipment.

Referring to FIG. 11, numerals (701) to (706) are tanks numbered 1 to 6 in this order which are filled with feedstocks (compounds in the vapor phase at normal temperatures) and carrier gases, and they are respectively connected to mass flow controller (713) to (718) numbered 1 to 6 in this order through regulating valves (707) to (712) numbered 1 to 6 in this order.

The carrier gas employed in the invention may be a hydrogen gas, an argon gas, a helium gas or the like.

In FIG. 11, numerals (719) to (721) are vessels numbered 1 to 3 in this order which contains feedstock compounds in the liquid or solid phase at normal temperatures, which can be respectively preheated by heaters (722) to (724) numbered 1 to 3 in this order so as to vaporize the feedstock compounds, and which are also connected to mass flow controller (728) to (730) numbered 7 to 9 in this order through regulating valves (725) to (727) numbered 7 to 9 in this order.

These gases are mixed in a mixer (731), and then sent to a reaction chamber (733) through a main pipe (732). The piping can be preheated by pipe heaters (734) arranged at adequate positions so that the gases which are vaporized forms of the feedstock compounds in the liquid or solid states at normal temperatures may be prevented from being condensated or congealed in the pipes.

The reaction chamber is equipped with a grounding electrode (735) and a power-applying electrode (736) opposed to each other, which can be respectively preheated by a heater (737).

The power-applying electrode (736) is connected to a high frequency power source (739) through a high frequency power matching box (738), to a low frequency power source (741) through a low frequency power matching box (740), and to a direct current power source (743) through a low pass filter (742) so that the power applying electrode (736) can be charged with electric power of different frequency, e.g. of a low frequency of 10 KHz to 1000 KHz, or of a high frequency of 13.56 MHz by a connection-selecting switch (744). In addition, direct electric power may be further applied thereto.

The pressure in the reaction chamber (733) can be controlled by a pressure control valve (745), and can be reduced through an exhaust system selecting valve (746) by a diffusion pump (747) and an oil-sealed rotary vacuum pump (748), or by a cooling-elimination device (749), a mechanical booster pump (750) and an oil-sealed rotary vacuum pump (748).

The exhaust gases are discharged into the ambient atmosphere after conversion to a safe unharmed gas by an adequate elimination device (753).

The piping in the exhaust system is also equipped with pipe heaters (734) disposed at adequate positions in the pipe line, and can be preheated so that the vaporized feedstock compounds can be prevented from being congealed in the piping.

The reaction chamber (733) is also equipped with a heater (751), and can be preheated thereby. A conductive substrate (752) is set on the grounding electrode disposed inside the reaction chamber (733).

These heaters as described above may not be always equipped according to the properties of the feedstocks used. Specifically, in the case where organic compounds with a boiling point of −50° to +15° C. under normal pressure are employed as raw material gases, some of the above mentioned heaters are often unnecessitated. Advantageously, this can simplify the production equipment.

It is however to be noted that in the case where organic compounds with a boiling point of less than −50° C. are employed as row material gases, these heaters are necessitated in order to prevent the generation of fine particles of polymers of raw materials in the chamber (733). In addition, in the case where organic compounds with a boiling point of more than 15° C. are employed as raw material gases, the respective heaters are necessitated in order to prevent the aggregation of the raw material gases in the respective pipes.

The substrate (752) is fixed on the grounding electrode (735), but it may be fixed on the power-applying electrode (736), or substrates may be fixed on both electrodes (735) and (736).

The equipment shown in FIG. 12 has the same construction as that of the equipment shown in FIG. 11 with the exception that a reaction chamber (733) is modified to suit to a cylindrical substrate (752). In this equipment, the cylindrical substrate (752) is also used for serving as a grounding electrode (735), and a power-applying electrode (736) and an electrode heater (737) are formed cylindrically.

With this construction, the reaction chamber for producing photosensitive members is previously reduced in pressure to about $10^{-4}$ to about $10^{-3}$ Torr by a diffusion pump to check the degree of vacuum, and to remove the gases absorbed in the equipment. Simultaneously, the cylindrical substrate serving as the electrode is heated to a predetermined temperature by the electrode heater.

With respect to the substrate, a photosensitive member with a photosensitive layer per se known on an electrically conductive substrate is used. Specifically, the temperature of the substrate is set to about 100° C. or less (a room temperature to 100° C.) so as to prevent the thermal denaturation of the organic photosensitive layer. In addition, the substrate is tightly covered with a sheet, a film, mesh or the like having pores so as to form specks of amorphous hydrocarbon on the photosensitive layer.

Next, the material gases from any of the first to the sixth tanks, or from any of the first to the third vessels are introduced into the reaction chamber with being supplied in the constant amount by any of the first to the ninth mass flow controllers, while the pressure of the reaction chamber is maintained to approximately 0.05 Torr to approximately 5.0 Torr by the pressure control valve.

After the gas flow is stabilized, the low frequency power source, for example, is selected by the connection selecting switch, thereby low frequency power is supplied to the power-supplying electrode.

Then, electrical discharge is started between the both electrodes, so that a solid state amorphous hydrocarbon layer is formed on the substrate with time. The layer deposition speed is 10 Å to 3 μm per min., preferably 100 Å to 1 μm per min., and more preferably 500 to 5000 Å per min. If the layer deposition speed is lower than 10 Å per min., the producibility of layers is poor. If it is higher than 3 μm per min., the resultant layers tend to have rough surfaces, resulting in poor producibility of uniform layers.

When the layer thickness has reached the predetermined value, the discharge is stopped, thus obtaining the photosensitive member of the present invention.

The surface protective layer of the present invention prepared as described above is not of crystals since it has no definite X-ray diffraction peak. Furthermore, since it has an absorption peak on the infrared absorption spectrum resulted from the bonds of carbon atoms and hydrogen atoms, the surface protective layer contains carbon atoms and hydrogen atoms as the constituent atoms. From these facts, it is apparent that this surface protective layer is an amorphous hydrocarbon layer.

Furthermore, in the surface protective layer as produced above, the absorption peak resulted from the bonds of halogen atoms and carbon atoms are sometimes observed on the infrared absorption spectrum, when fluorine atoms are incorporated.

Illustrating the invention are the following examples, which, however, are not to be construed as limiting the invention to their details.

EXAMPLES AND COMPARATIVE EXAMPLES

First, organic type photosensitive layers A to E, selenium type photosensitive layers F and G, amorphous silicon type photosensitive layer H, and cadmium sulfide/resin dispersion type photosensitive layer I were prepared.

Hereinafter, photosensitive layers formed on flat aluminum substrates of 50×50×3 mm (thickness) will be called photosensitive layers Ap to Ip, and those formed on cylindrical aluminum substrates of 80 mm diameters and 30 mm height will be called photosensitive layers Ad to Id.

Preparation of Organic Type Photosensitive Layer A

A mixture of 1 g of chlorodian blue as a bisazo pigment, 1 g of a polyester resin (v-20 made by TOYOBO CO., LTD.), and 98 g of cyclohexanone was dispersed for 13 hours with the use of a sand grinder. The obtained dispersion was applied to a flat aluminum substrate of 50×50×3 mm (thickness) with the use of a bar coater, and dried so that a charge-generating layer of a thickness of 3 μm could be formed thereon.

Next, 5 g of 4-diethylaminobenzaldehyde-diphenylhydrazone DEH, and 5 g of polycarbonate (K-1300 made by Teijin K.K.) were dissolved in 30 g of THF, and the obtained solution was applied to the charge-generating layer and dried so that a charge-transporting layer of a thickness of 15 μm might be formed thereon, thus obtaining an organic type photosensitive layer Ap.

An organic type photosensitive layer Ad was formed on a cylindrical aluminum substrate of 80 mm (diameter)×330 mm (height) in the same procedures as mentioned above, except that the charge-generating layer and the charge-transporting layer were formed by dipping.

COMPARATIVE EXAMPLE 1

The obtained organic type photosensitive layer Ap was subjected to a corona discharge treatment to be charged to −600 v by utilizing the conventional carlson process, and a white light exposure amount for reducing the initial charge amount to the half value thereof (hereinafter referred to as E1/2) was measured. As a result, E1/2 was 2.0 lux.sec., and the residual potential was −5 v. The pencil hardness of the photosensitive layer was measured based on JIS-K-5400 standards, resulting in the surface hardness of about 5B.

The other organic type photosensitive layer Ad showed the same properties as those of the photosensitive layer Ap. This photosensitive layer Ad was mounted on a copying machine and tested on the durability with respect to copy. After the duplication process was repeated 5,000 times by using copying paper of A4 size, the thickness of the photosensitive layer was decreased by 1 μm. From these facts, it could be confirmed that this photosensitive layer was excellent in the electrostatic characteristics, but poor in the durability.

Preparation of Organic Type Photosensitive Layer B

Organic type photosensitive layers Bp and Bd were prepared in the same procedures as those of the photosensitive layers Ap and Ad with the exception that methyl methacrylate (PMMA)(BR-35; made by Mitsubishi Rayon K.K. was employed instead of polycarbonate for forming a charge transporting layer.

COMPARATIVE EXAMPLE 2

The obtained organic type photosensitive layer Bp was subjected to a corona discharge treatment to be charged to −600 v by utilizing the known carlson process, and the E1/2 was measured, resulting in 6.2 lux.-sec., and the residual potential was −12 v. The pencil hardness of the photosensitive layer was also measured based on the JIS-K-5400 standards, resulting in the surface hardness of about B.

The organic type photosensitive layer Bd showed the same properties as those of the photosensitive layer Bp. This layer was mounted on a copying machine and tested on the durability with respect to copy. As a result, after the duplication process was repeated 8,000 times by using copying paper of A4 size, the thickness of the layer was decreased by 1 μm. From these facts, it could be confirmed that this layer was excellent in the electrostatic characteristics, but poor in the durability.

Preparation of Organic Type Photosensitive Layer C

Organic type photosensitive layers Cp and Cd were prepared in the same procedures as those of the photosensitive layers Ap and Ad with the exception that polyarylate (U-100; made by Yunitsica K.K.) was employed instead of polycarbonate.

COMPARATIVE EXAMPLE 3

The obtained organic type photosensitive layer Cp was subjected to a corona discharge treatment to be charged to −600 v by utilizing the known carlson process, and the E1/2 was measured, resulting in 2.3 lux.-sec., and the residual potential was −8 v. The pencil hardness of the photosensitive layer was also measured based on the JIS-K-5400 standards, resulting in the surface hardness of about 5B.

The organic type photosensitive layer Cd showed the same properties as those of the photosensitive layer Cp. This layer was mounted on a copying machine, and tested in the durability with respect to copy. As a result, after the duplication process was repeated 4,000 times by using copying paper of A4 size, the thickness of the layer was decreased by 1 μm. From these facts, it could be confirmed that this layer was excellent in the electrostatic characteristics, but poor in the durability.

Preparation of Organic Type Photosensitive Layer D

Organic type photosensitive layers Dp and Dd were prepared in the same procedures as those of the photosensitive layers Ap and Ad with the exception that polyester (v-200; made by TOYOBO CO., LTD.) was employed instead of polycarbonate.

COMPARATIVE EXAMPLE 4

The obtained organic type photosensitive layer Dp was subjected to a corona discharge treatment to be charged to −600 v by utilizing the known carlson process, and the E1/2 was measured, resulting in 2.2 lux.-sec., and the residual potential was −7 v. The pencil hardness of the photosensitive layer was also measured based on the JIS-K-5400 standards, resulting in the surface hardness of about 5B.

The organic type photosensitive layer Dd showed the same properties as those of the photosensitive layer Dp. This layer was mounted on a copying machine and tested on the durability with respect to copy. As a result, after the duplication process was repeated 5,000 times by using copying paper of A4 size, the thickness of the layer was decreased by 1 μm. From these facts, it could be confirmed that this layer was excellent in the electrostatic characteristics, but poor in the durability.

Preparation of Organic Photosensitive Layer E

A mixed solution of 5 parts by weight of special α type copper phthalocyanine (made by Toyo Ink K.K.), 50 parts by weight of acrylic melamine thermosetting resin (a mixture of A-405 with Super Beckamine J820; made by Dainippon Ink K.K.), 25 parts by weight of 4-diethylaminobenzaldehyde-diphenylhydrazone, and 500 parts by weight of an organic solvent (a mixture of 7 parts by weight of xylene with 3 parts by weight of butanol) was dispersed for 10 hours with the use of a ball mill. The obtained dispersion solution was applied to a flat aluminum substrate of 50×50×3 mm(thickness) with the use of a bar coater, dried, and baked at 150° C. for one hour so that a layer of 15 μm thickness could be formed thereon. Thus, an organic type photosensitive layer Ep was obtained.

This dispersion solution was also applied to a cylindrical aluminum substrate of 80 mm (diameter)×330 mm (height) by the dipping method, and an organic photosensitive layer was formed thereon in the same procedures as mentioned above.

COMPARATIVE EXAMPLE 5

The obtained organic type photosensitive layer Ep was subjected to a corona discharge treatment to be charged to +600 v by utilizing the known carlson process, and the E1/2 was measured, resulting in 4.3 lux.-sec., and the residual potential was +5 v. The pencil hardness of the photosensitive layer was also measured based on the JIS-K-5400 standards, resulting in the surface hardness of about 1B.

The organic type photosensitive layer Ed showed the same properties as those of the photosensitive layer Ep. This layer was mounted on a copying machine, and tested on the durability with respect to copy. As a result, after the duplication process was repeated 10,000 times by using copying paper of A4 size, the thickness of the layer was decreased by 1 μm. From these facts, it could be confirmed that this layer was excellent in the electrostatic characteristics, but poor in the durability.

Preparation of Selenium Type Photosensitive Layers F and G

Using a vapor-depositing equipment as shown in FIG. 13, a Se-As photosensitive layer Fp of a thickness of about 50 μm, which was a single-layer structure of the alloy of selenium and arsenic, was obtained by depositing the alloy in vacuum on electric resistance heating. A Se/Te photosensitive layer Gp of a laminated type having a selenium layer and a selenium-tellurium alloy layer in this order was obtained.

Figure 14:
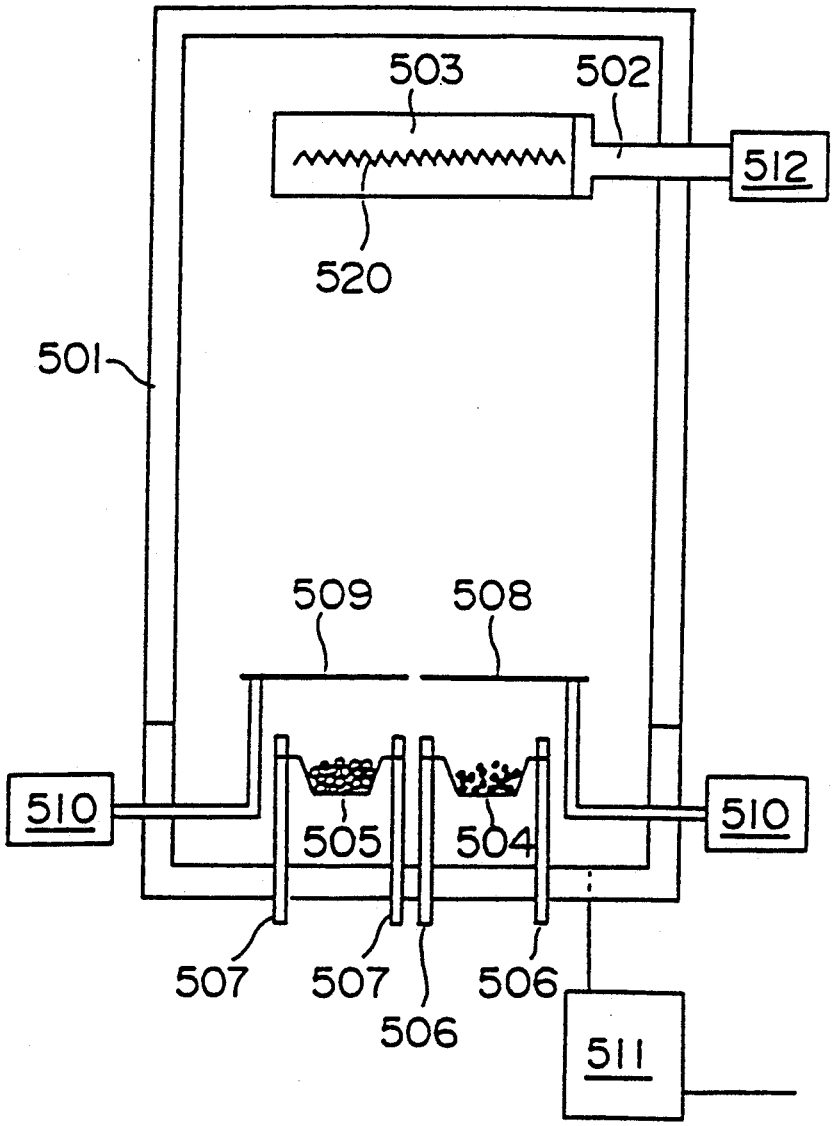

Using the vapor depositing equipment as shown in FIG. 14, a Se-As photosensitive layer Fd and a Se-Te photosensitive layer Gd were respectively formed on cylindrical aluminum substrates of 80 mm (diameter)×330 mm (height) in the same procedures as mentioned above.

COMPARATIVE EXAMPLE 6

The obtained selenium type photosensitive layer Gp was charged to 800 v, and irradiated by a monochromatic light of a wavelength of 780 nm. The E1/2 and the residual potential Vr were measured. As a result, the E1/2 was approximately 1 $\mu J/cm^2$, and the Vr was approximately 40 v. The pencil hardness was also measured, resulting in the surface hardness of about 1H.

The photosensitive layer Gd showed the same properties as those of the photosensitive layer Gp. This layer Gd was mounted on a copying machine, and tested in the durability with respect to copy. After the duplication process was repeated about 100,000 times by using copying paper of A4 size, linear-arranged so called white spots were observed in the copied images.

From these facts, it could be confirmed that this photosensitive layer was excellent in the electrostatic characteristics, but poor in the durability.

Preparation of Amorphous Silicon Type Photosensitive Layer H

Step (1)

In the glow discharge decomposition equipment shown in FIG. 11, after raising the pressure of the reaction chamber (733) to a high vacuum degree of about $10^{-6}$ Torr, the first to third, and fifth regulating valves (707), (708), (709), and (711) were opened, thereby introducing $H_2$ gas from the first tank (701), 100% $SiH_4$ gas from the second tank (702), $B_2H_6$ gas diluted to 200 ppm with $H_2$ from the third tank (703), and $C_2H_4$ gas from the fifth tank (705), into the mass flow controllers (713), (714), (715), and (717) under output pressure gage reading of 1 $Kg/cm^2$. Then, by adjusting the graduations of the mass flow controllers, the flow rate of $H_2$ was set to 300 sccm, that of $B_2H_6$ (200 ppm/$H_2$) to 100 sccm, and that of $C_2H_4$ to 120 sccm, and they were introduced into the reaction chamber (733). After the respective flow rates had been stabilized, the internal pressure of the reaction chamber (733) was adjusted to 1.0 Torr. As a substrate (752), a plate type aluminum of 50×50×3 mm (thickness) was employed, and it was preheated to 250° C. The high frequency power source (739) was turned on in the stabilized flow rate under the stabilized internal pressure, thereby applying an electric power of 200 watts (the frequency of 13.56 MHz) to the electrode (736) to cause a glow discharge. This glow discharge treatment was carried out for 3.5 minutes to form a first layer of about 0.35 thickness containing hydrogen and boron on the electrically conductive substrate (752).

Step (2)

After forming the first layer, the regulating valve (711) was closed without stopping the power application from the high frequency power source, thereby setting the flow rate of mass flow controller (717) to 0 within 30 seconds. A second layer of 0.05 $\mu m$ thickness was formed under the same conditions as those of Step (1) other than this.

Step (3)

After forming the second layer, the power application from the high frequency power source (739) was stopped, and the flow rate value of the mass flow controller was set to 0, and the reaction chamber (733) inside was degassed. After that, 400 sccm of $H_2$ gas from the first tank (701), 200 sccm of 100% $SiH_4$ from the second tank (702), 200 sccm of $B_2H_6$ gas diluted to 200 ppm with $H_2$ from the third tank (703), and 2 sccm of $O_2$ gas from the sixth tank were introduced into the reaction chamber, and the internal pressure was adjusted to 1.0 Torr. Then, the high frequency power source was turned on, thereby applying a power of 300 watts. The discharge treatment was continued for about 4 hours to form a third layer of about 28 $\mu m$ thickness. Thus, an amorphous silicon type photosensitive layer Hp was obtained. Using the glow discharge decomposition equipment shown in FIG. 12, an amorphous silicon type photosensitive layer Hd was formed on a cylindrical aluminum substrate in the same production steps.

COMPARATIVE EXAMPLE 7

The obtained a-Si type photosensitive layer Hp was subjected to a corona discharge treatment to be charged to +600 v by using the Carlson process, and the $E_1/2$ was measured. It was about 1 lux.sec., and the residual potential was about 20 v.

In addition, the Vickers hardness measurement was carried out with respect to the surface of the layer. It was about 1,800 $kg/mm^2$.

The a-Si type photosensitive layer Hd was set in a dust figure transfer type camera (EP-650Z: made by Minolta Camera K.K.), and actual copying operations were carried out with (+) charge. The copied images were excellent in the resolving power, the gradation reproducibility with high density. After the 20,000 times of multi-duplication using copying paper of A4 size, the layer thickness was not decreased. However, flows occurred in the copied images when copying operation was carried out at 30° C. under 85% humidity atmosphere.

From these facts, it could be confirmed that this photosensitive layer was excellent in the electrostatic characteristics and in the mechanical durability, but poor in the humidity resistance.

Preparation of Cadmium Sulfide/Resin Dispersion Type Photosensitive Layer 1

A cadmium sulfide/resin dispersion type photosensitive layer Ip was prepared by applying the dispersion of $CdS.nCdCo_3(0<n\leqq 4)$ photoconductive specks with a thermosetting acrylic resin, to a plate type aluminum substrate in about 30 $\mu m$ thickness, and by thermosetting the same.

A cadmium sulfide/resin dispersion type photosensitive layer Id was formed on a cylindrical aluminum substrate in the same production steps.

COMPARATIVE EXAMPLE 8

The obtained photosensitive layer Id was mounted on a copying machine, and copying operations were carried out under the normal room atmosphere. The obtained copied images were clear and having a high density. Flows were caused in the copied images when copying operations were carried out at 30° C. under 85% humidity atmosphere.

From these facts, it could be confirmed that this photosensitive layer was poor in the humidity resistance.

EXAMPLE 1

(Formation of Resin Layer)

One part by weight of polycarbonate (K-1300; Teijin Kasei K.K. . . . ) was dissolved in 10 parts by weight of THF. This solution was applied to the substrate coated with the organic type photosensitive layer Ap, and dried so that the resultant layer thickness could be 0.1 $\mu m$. Thus, a resin layer was formed.

(Formation of Surface Protective Layer)

Using the glow discharge decomposition equipment shown in FIG. 11, a surface protective layer was formed on the resin layer. First, the interior pressure of the reaction tank (733) was increased to a high vacuum degree of about $10^{-6}$ Torr, and then, the first, second, and third regulating valves (707), (708), and (709) were opened, thereby respectively introducing the hydrogen gas from the first tank (701), the butadiene gas from the second tank (702), and the tetrafluoride methane gas from the third tank (703) into the first, second, and third mass flow controller (713), (714), and (715) under the output pressure of 1.5 Kg/cm$^2$. Then, by adjusting the graduations of the respective mass flow controllers, the flow rate of hydrogen gas was set to 300 sccm, that of butadiene gas to 15 sccm, and that of tetrafluoromethane gas to 90 sccm. They passed into the mixer (731), and were introduced into the reaction chamber (733) through the main pipe (732). After the respective flow rates were stabilized, the pressure control valve (745) was adjusted to control the interior pressure of the reaction chamber (733) to 0.5 Torr.

The substrate (752) was previously covered with a nickel sheet mask. In the shape of the sheet mask, the pores were 43 μm square, and the distance therebetween was about 11 μm.

Next, the substrate (752) was fixed on the grounding electrode (735) inside the reaction chamber (733). The substrate (752) was heated to 50° C. from the ordinal temperature in about 15 minutes before the introduction of the gases. With the gas flows and the pressure stabilized, the low frequency power source (741) having been connected by the connection selecting switch (744) was turned on, and applied an electric power of 150 W (frequency 80 KHz) to the power applying electrode (736), thereby causing plasma polymerization reaction for about 2 minutes. Thus, a surface protective layer constituting of specks of an amorphous hydrocarbon layer of 0.1 μm thickness was formed on the substrate (752). The shapes of the specks were the same as shown in FIG. 9. The specks of about 43 μm square were distributed at about 11 μm intervals over the substrate. After forming the layer, the power application was stopped, and the regulating valves other than that of hydrogen gas were closed, thereby introducing only hydrogen gas in the flow rate of 100 sccm into the reaction chamber (733). Then, the reaction chamber (733) was cooled to about 30° C. with the pressure maintained at 1 Torr. After that, the regulating valve (707) of hydrogen gas was closed, so that the gases of the reaction chamber (733) were sufficiently exhausted to collapse the vacuum state therein. After that, the photosensitive member coated with the resin layer and the surface protective layer was taken out therefrom.

(Characteristics)

The pencil hardness of the photosensitive member was measured based on the JIS-K-5400 standards. As a result, it was about 6H at the portions at which the specks were adhered. From this fact, it could be confirmed that the surface protective layer of the present invention could improve the hardness of the photosensitive member.

The sensitivity characteristics were almost at the same level as that of Comparative Example 1. From this fact, it could be confirmed that the photosensitive member of the present invention did not lower the original sensitivity of the organic type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the resin layer and the surface protective layer did not occur. From this fact, it could be confirmed that the resin layer and the surface protective layer of the present invention were excellent in the adhesion property to organic type photosensitive members In this connection, the tables 1 to 3 show the production conditions, shapes, and characteristics of the surface protective layers prepared. They show also the production conditions, shapes, and characteristics of the following examples 2 to 10.

EXAMPLE 2

(Formation of Resin Layer)

One part by weight of polycarbonate (K-1300, made by Teijin Kasei K.K. . . . ) was dissolved in 10 parts by weight of THF, and this solution was applied to the substrate coated with the organic type photosensitive layer Ad, and dried so that the resultant layer thickness could be 0.06 μm. Thus, a resin layer was obtained.

(Formation of Surface Protective Layer)

Using the glow discharge decomposition equipment shown in FIG. 12, a surface protective layer was formed on the resin layer. First, the interior pressure of the reaction tank (733) was increased to a high vacuum degree of about $10^{-6}$ Torr, and then, the first, and second regulating valves (707), and (708) were opened, thereby respectively introducing the hydrogen gas from the first tank (701), and the butadiene gas from the second tank (702) into the first, and second mass flow controller (713), and (714) under the output pressure of 1.5 Kg/cm$^2$. Then, by adjusting the graduations of the respective mass flow controllers, the flow rate of hydrogen gas was set to 300 sccm, and that of butadiene gas to 15 sccm. Then, the both gases passed into the mixer (731), and were introduced into the reaction chamber (733) through the main pipe (732). After the respective flow rates were stabilized, the pressure control valve (752) was adjusted to control the interior pressure of the reaction chamber (733) to 0.3 Torr.

The cylindrical substrate (752) was previously covered with a nylon stretchable tubular mesh of about 50 mm diameter and about 300 mm length. In the shape of the tubular mesh, the pores were about 100 μm in pore size, and the intervals therebetween were about 15 μm.

Next, the substrate (752) was fixed on the grounding electrode (735) inside the reaction chamber (733). The substrate (752) was heated to 50° C. from the ordinal temperature in about 15 minutes before the introduction of the gases. With the gas flows and the pressure stabilized, the low frequency power source (741) having been previously connected by the connection selecting switch (744) was turned on, and applied an electric power of 150 W (frequency of 80 KHz) to the power applying electrode (736), thereby causing plasma polymerization reaction for about 4 minutes. Thus, a surface protective layer constituted of specks of an amorphous hydrocarbon layer of 0.15 μm thickness was formed on the substrate (752). The shapes of the specks were the same as those shown in FIG. 10. The specks having the maximal width (W) of about 100 μm were distributed at about 15 μm intervals over the substrate. After forming the layer, the power application was stopped, and the regulating valves other than that of hydrogen gas were closed, thereby introducing only hydrogen gas at the flow rate of 100 sccm into the reaction chamber (733). Then, the reaction chamber (733) was cooled to about 30° C. with the pressure maintained at 1 Torr. After that, the regulating valve (707) of hydrogen gas was closed, so that the gases of the reaction chamber (733) were sufficiently exhausted to collapse the vacuum state therein. After that, the photosensitive member coated with the resin layer and the surface protective layer was taken out therefrom.

(Characteristics)

The pencil hardness of the photosensitive member was measured based on the JIS-K-5400 standards. As a result, it was about 9H at resin layer. From this fact, it could be confirmed that the surface protective layer of the present invention could improve the hardness of the photosensitive member.

The sensitivity characteristics were almost at the same level as those of Comparative Example 1. From this fact, it could be confirmed that the photosensitive member of the present invention did not lower the original sensitivity of the organic type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the resin layer and the surface protective layer did not occur. From this fact, it could be confirmed that the resin layer and the surface protective layer of the present invention were excellent in the adhesion property to organic type photosensitive members.

The obtained photosensitive member was mounted on the copying machine (EP-650Z; made by Minolta Camera K.K. . . . ) and actual copying operations were carried out. Resultant copied images were clear and image flows did not occur in the copied images even when actual copying operations were carried out under the atmosphere of the relative humidity of 80% at 35 ° C.

Furthermore, the contact of the photosensitive member with developers, sheets of copying paper and cleaning members in the copying machine did not cause the peeling of the resin layer and the surface protective layer.

Still furthermore, the duplication tests were repeated 350,000 times under the ordinary room atmosphere. As a result, the copied images were clear throughout the tests. Moreover, even after the duplication tests were repeated 350,000 times, the thickness of the photosensitive layer was not decreased, and the flows of the copied images did not occur even under the atmosphere of the temperature of 35° C. and the relative humidity of 80%. From these facts, it could be confirmed that the surface protective layer of the present invention could improve the durability of photosensitive member without lowering the image quality.

EXAMPLE 3

(Formation of Resin Layer)

A thermosetting acrylic melamine resin was dissolved in an organic solvent (a mixture of 7 parts by weight with xylene and 3 parts by weight of butanol). This solution was applied to a substrate coated with the organic type photosensitive layer Bd, dried, and baked so that the resultant layer thickness could be 0.06 μm. Thus, a resin layer was formed.

(Formation of Surface Protective Layer)

Using the vapor deposition equipment shown in FIG. 14, a surface protective layer was formed on the resin layer.

First, the cylindrical substrate (503) was covered with a stretchable 66 nylon tubular mesh of about 50 mm diameter and 300 mm length. In the shape of the tubular mesh, the pores were about about 90 μm in pore size, and the interval therebetween was about 20 μm.

Next, the substrate (503) was fixed on the substrate supporting member (502). A boat (504) was charged with the powder of silicon oxide or SiO.

Then, the interior pressure of a vacuum chamber (501) was adjusted to a high vacuum degree of about $10^{-7}$ Torr with the use of an exhaust pump (511), and electric power was applied to an electrode (506) to heat the boat (504) to 1080° C. When the temperature of the boat (504) was stabilized, a motor (512) was driven to rotate the substrate (503) at about 10 rotations per min. With this state, a shutter (508) having been previously closed was opened for about 3 minutes by a rotation lever (510), while deposition was carried out under the atmosphere of a vacuum degree of about $10^{-5}$ Torr to form a surface protective layer constituted of the specks of a SiO layer of about 0.15 μm thickness on the substrate (503).

The shapes of the specks were the same as those shown in FIG. 10. The specks having the width (W) of about 90 μm were distributed at about 20 μm intervals on the substrate. After forming the surface protective layer, the power application to the electrode (506) was stopped, and the gases of the vacuum chamber (501) was sufficiently exhausted to collapse the vacuum state therein. After that, the photosensitive member coated with the resin layer and the surface protective layer was taken out therefrom.

(Characteristics)

The pencil hardness of the photosensitive member was measured based on the JIS-K-5400 standards. As a result, it was about 7H at the portion at which the specks were adhered to the resin layer. From this fact, it could be confirmed that the surface protective layer of the present invention could improve the hardness of the photosensitive member.

The sensitivity characteristics were almost at the same level as those of Comparative Example 2. From this fact, it could be confirmed that the photosensitive member of the present invention did not lower the original sensitivity of the organic type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the resin layer and the surface protective layer did not occur. From this fact, it could be confirmed that the resin layer and the surface protective layer of the present invention were excellent in the adhesion property to organic type photosensitive members.

The obtained photosensitive member was mounted on the copying machine (EP-650Z; made by Minolta Camera K.K. . . . ), and actual copying operations were carried out. The resultant copied images were clear well defined, and image flows did not occur in the copied images even when actual copying operations were carried out under the atmosphere of the relative humidity of 80% at 35 ° C.

Furthermore, the contact of the photosensitive member with developers, sheets of copying paper and cleaning members in the copying machine did not cause the peeling of the resin layer and the surface protective layer.

Still furthermore, the duplication tests were repeated 300,000 times under the ordinary room atmosphere. As a result, the copied images were clear throughout the tests. Moreover, even after the duplication tests were repeated 300,000, times, the thickness of the photosensitive layer was not decreased, and the flows of the copied images did not occur even under the atmosphere of the temperature of 35° C. and the relative humidity of 80%. From these facts, it could be confirmed that the surface protective layer of the present invention could improve the durability of photosensitive member without lowering the image quality.

EXAMPLE 4

(Formation of Resin Layer)

A thermosetting acrylic melamine resin was dissolved in an organic solvent (a mixture of 7 parts by weight xylene and 3 parts by weight of butanol). This solution was applied to the substrate coated with the organic type photosensitive layer Ed, dried, and baked so that the resultant layer thickness could be 0.06 μm. Thus, a resin layer was formed.

(Formation of Surface Protective Layer)

Using the vapor deposition equipment shown in FIG. 14 a surface protective layer was formed on the resin layer.

First, a substrate (503) was covered with a heat-shrinkable polyvinyl chloride tubular mesh of about 90 mm diameter and 300 mm length. The substrate covered with the tubular mesh was subjected to a hot air treatment at 50° C. in an oven to heat-shrink the mesh to tightly cover the substrate. In the shape of the tubular mesh, the pores were about 100 μm in pore size, and the interval between the pores was 25 μm.

Next, the substrate (503) was fixed on a substrate supporting member (502). A boat (504) was charged with the powder of aluminum oxide or $Al_2O_3$.

Then, the interior pressure of a vacuum chamber (501) was adjusted to a high vacuum degree of about $10^{-7}$ Torr with the use of an exhaust pump (511), and electric power was applied to an electrode (506) to heat the boat (504) to 1450° C. When the temperature of the boat (504) was stabilized, a motor (512) was driven to rotate the substrate (503) at about 10 rotations per min. With this state, a shutter (508) having been previously closed was opened for about 5 minutes by a rotation lever (510), while deposition was carried out under the atmosphere of a vacuum degree of about $10^{-5}$ Torr to form a surface protective layer constituted of the specks of a $Al_2O_3$ layer of about 0.15 μm thickness on the substrate (503).

The shapes of the specks were the same as those shown in FIG. 7. The specks of about 100 μm diameter were distributed at about 25 μm intervals on the resin layer. After forming the surface protective layer, the power application to the electrode (506) was stopped, and the gases of the vacuum chamber (501) was sufficiently exhausted to collapse the vacuum state therein. After that, the photosensitive member coated with the resin layer and the surface protective layer was taken out therefrom.

(Characteristics)

The pencil hardness of the photosensitive member was measured based on the JIS-K-5400 standards. As a result, it was about 9H at the portions at which the specks were adhered to the resin layer. From this fact, it could be confirmed that the surface protective layer of the present invention could improve the hardness of the photosensitive member.

The sensitivity characteristics were almost at the same level as that of Comparative Example 5. From this fact, it could be confirmed that the photosensitive member of the present invention did not lower the original sensitivity of the organic type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the resin layer and the surface protective layer did not occur. From this fact, it could be confirmed that the resin layer and the surface protective layer of the present invention were excellent in the adhesion property to organic type photosensitive members.

The obtained photosensitive member was mounted on the copying machine (EP-650Z; made by Minolta Camera K.K. . . . ), and actual copying operations were carried out. The resultant copied images were clear and image flows did not occur in the copied images even when actual copying operations were carried out at the temperature of 35° C. under the atmosphere of the relative humidity of 80%.

Furthermore, the contact of the photosensitive member with developers, sheets of copying paper and cleaning members in the copying machine did not cause the peeling of the resin layer and the surface protective layer.

Still furthermore, the duplication tests were repeated 300,000 times under the ordinary room atmosphere. As a result, the copied images were clear throughout the tests. Moreover, even after the duplication tests were repeated 300,000 times, the thickness of the photosensitive layer was not decreased, and the flows of the copied images did not occur even under the atmosphere of the temperature of 35° C. and the relative humidity of 80%. From these facts, it could be confirmed that the surface protective layer of the present invention could improve the durability of photosensitive member without lowering the image quality.

EXAMPLE 5

(Formation of Resin Layer)

One part by weight of polycarbonate (K-1300, made by Teijin Kasei K.K. . . . ) was dissolved in 10 parts by weight of THF. This solution was applied to the substrate coated with the Se type photosensitive layer Fp, and dried so that the resultant layer thickness could be 0.06 μm. Thus, a resin layer was formed.

(Formation of Surface Protective Layer)

Using the vapor deposition equipment shown in FIG. 13, a surface protective layer was formed on the resin layer.

First, a substrate (503) was tightly covered with a nickel sheet mask. In the shape of the sheet mask, the pores were about 85 μm square, and the interval between the pores was about 15 μm.

Next, the substrate (503) was fixed on the substrate supporting member (502). A boat (504) was charged with the powder of silicon oxide(SiO)

Then, the interior pressure of a vacuum chamber (501) was adjusted to a high vacuum degree of about $10^{-7}$ Torr with the use of an exhaust pump (511), and electric power was applied to an electrode (506) to heat the boat (504) to 1080° C. When the temperature of the boat (504) was stabilized, a shutter (508) having been previously closed was opened for about 3 minutes by a rotation lever (510), while deposition was carried out under the atmosphere of a vacuum degree of about $10^{-5}$ Torr to form a surface protective layer constituted of the specks of a SiO layer of about 0.15 μm thickness on the substrate (503).

The shapes of the specks were the same as those shown in FIG. 9. The square specks of about 85 μm square were distributed at about 15 μm intervals on the substrate. After forming the surface protective layer, the power application to the electrode (506) was stopped, and the gases of the vacuum chamber (501) was sufficiently exhausted to collapse the vacuum state therein. After that, the photosensitive member coated with the resin layer and the surface protective layer was taken out therefrom.

(Characteristics)

The pencil hardness of the photosensitive member was measured based on the JIS-K-5400 standards. As a result, it was about 7H at the portion at which the specks were adhered to the resin layer. From this fact, it could be confirmed that the surface protective layer of the present invention could improve the hardness of the photosensitive member.

The sensitivity characteristics were almost at the same level as those of Comparative Example 6. From this fact, it could be confirmed that the photosensitive member of the present invention did not lower the original sensitivity of the Se-type organic type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the resin layer and the surface protective layer did not occur. From this fact, it could be confirmed that the resin layer and the surface protective layer of the present invention were excellent in the adhesion property to Se-type organic type photosensitive members.

EXAMPLE 6

(Formation of Resin Layer)

An acrylic melamine thermosetting resin was dissolved in an organic solvent (a mixture of 7 parts by weight of xylene with 3 parts by weight of butanol). This solution was applied to the substrate coated with the selenium type type photosensitive layer Gd, dried, and baked so that the resultant layer thickness could be 0.06 μm. Thus, a resin layer was formed.

(Formation of Surface Protective Layer)

Using the glow discharge decomposition equipment shown in FIG. 12, a surface protective layer was formed on the resin layer. First, the interior pressure of the reaction tank (733) was raised to a high vacuum degree of about $10^{-6}$ Torr, and then, the first, second, and third regulating valves (707), (708), and (709) were opened, thereby respectively introducing the hydrogen gas from the first tank (701), the butadiene gas from the second tank (702), and the tetrafluoromethane gas from the third tank (703) into the first, second, and third mass flow controller (713, 714, and 715) under the output pressure of 1.5 Kg/cm$^2$. Then, by adjusting the graduations of the respective mass flow controllers, the flow rate of hydrogen gas was set to 300 sccm, that of butadiene gas to 15 sccm, and that of tetrafluoromethane gas to 90 sccm. They passed into the mixer (731), and were introduced into the reaction chamber (733) through the main pipe (732). After the respective flow rates were stabilized, the pressure control valve (752) was adjusted to control the interior pressure of the reaction chamber (733) to 0.5 Torr.

The substrate (752) was previously covered with a nylon stretchable tubular mesh of about 50 mm diameter, and about 300 mm length. In the shape of the mesh, the pores were about of 90 μm in pore size, and the interval therebetween was about 20 μm.

Next, the substrate (752) was fixed on the grounding electrode (735) inside the reaction chamber (733). The substrate (752) was heated to 50° C. from the ordinal temperature in about 15 minutes before the introduction of the gases. With the gas flow and the pressure stabilized, the low frequency power source (741) having been connected by the connection selecting switch (744) was turned on, and applied electric power of 150 W (frequency 80 KHz) to the power applying electrode (736), thereby causing plasma polymerization reaction for about 2 minutes. Thus, a surface protective layer constituted of specks of an amorphous hydrocarbon layer of 0.1 μm thickness was formed over the substrate (752). The shapes of the specks were the same as those shown in FIG. 10. The specks having the width (W) of about 90 μm were distributed at about 20 μm intervals over the substrate. After forming the layer, the power application was stopped, and the regulating valves other than that of hydrogen gas were closed, thereby introducing only hydrogen gas in the flow rate of 100 sccm into the reaction chamber (733). Then, the reaction chamber (733) was cooled to about 30° C. with the pressure maintained at 1 Torr. After that, the regulating valve (707) of hydrogen gas was closed, so that the gases of the reaction chamber (733) were sufficiently exhausted to collapse the vacuum state therein. After that, the photosensitive member coated with the resin layer and the surface protective layer was taken out therefrom.

(Characteristics)

The pencil hardness of the photosensitive member was measured based on the JIS-K-5400 standards. As a result, it was about 6H at the portions at which the specks were protective layer was adhered. From this fact, it could be confirmed that the surface protective layer of the present invention could improve the hardness of the photosensitive member.

The sensitivity characteristics were almost at the same level as those of Comparative Example 6. From this fact, it could be confirmed that the photosensitive member of the present invention did not lower the original sensitivity of the selenium type organic type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the resin layer and the surface protective layer did not occur. From this fact, it could be confirmed that the resin layer and the surface protective layer of the present invention were excellent in the adhesion property to selenium type type photosensitive members.

The obtained photosensitive member was mounted on the copying machine (EP-650Z; made by Minolta Camera K.K. . . . ), and actual copying operations were carried out. The resultant copied images were clear and image flows did not occur in the copied images even when actual copying operations were carried out under the atmosphere of the relative humidity of 80% at 35 ° C.

Furthermore, the contact of the photosensitive member with developers, sheets of copying paper and cleaning members in the copying machine did not cause the peeling of the resin layer and the surface protective layer.

Still furthermore, the duplication tests were repeated 300,000 times under the ordinary room atmosphere. As a result, the copied images were clear throughout the tests. Moreover, even after the duplication tests were repeated 300,000 times, the thickness of the photosensitive layer was not decreased, and the flows of the copied images did not occur even under the atmosphere of the temperature of 35° C. and the relative humidity of 80%. From these facts, it could be confirmed that the surface protective layer of the present invention could improve the durability of photosensitive member without lowering the image quality.

EXAMPLE 7

(Formation of Resin Layer)

One part by weight of polycarbonate (K-1300; made by Teijin Kasei K.K.. . . ) was dissolved in 10 parts by weight of THF. This solution was applied to the substrate coated with the a-Si type photosensitive layer Hp, and dried so that the resultant layer thickness could be 0.1 μm. Thus, a resin layer was formed.

(Formation of Surface Protective Layer)

A surface protective layer was formed on the resin layer by the sputtering process of a high frequency (13.56 MHz).

First, a nickel sheet mask was adhered to the substrate. In the shape of the sheet mask, the pores were 85 μm square and the interval therebetween was about 15 μm.

Next, the substrate (752) was fixed on the grounding electrode inside a high frequency sputtering deposition equipment (not shown). A high frequency power applying electrode opposed thereto was covered with a plate of magnesium fluoride ($MgF_2$) of about 5 mm thickness which serves as a target.

The interior pressure of the vacuum chamber was adjusted to a high vacuum degree of about $10^{-7}$ Torr with the use of an exhaust pump, and an argon gas used for the sputtering process was introduced into the vacuum chamber to set its pressure to 0.1 Torr. Next, electric power of 200 W was applied to the electrode under a frequency of 13.56 MHz, thereby carrying out the sputtering process for about 10 minutes. Thus, a surface protective layer constituted specks of the $MgF_2$ layer of 0.1 μm thickness was formed on the substrate. The shapes of the specks were the same as those shown in FIG. 9. The specks having about 85 μm were distributed at about 15 μm intervals over the substrate. After forming the layer, the power application was stopped, and the gasses inside the vacuum chamber were exhausted to collapse the vacuum state therein. After that, the photosensitive member with the resin layer and the surface protective layer was taken out therefrom.

(Characteristics)

The pencil hardness of the photosensitive member was measured based on the JIS-K-5400 standards. As a result, it was about 7H at the portion at which the specks were adhered.

The sensitivity characteristics were almost at the same level as those of Comparative Example 7. From this fact, it could be confirmed that the photosensitive member of the present invention did not lower the original sensitivity of the a-Si type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minutes intervals. As a result, the peeling or cracks of the resin layer and the surface protective layer did not occur. From this fact, it could be confirmed that the resin layer and the surface protective layer of the present invention were excellent in the adhesion property to a-Si type photosensitive members.

EXAMPLE 8

(Formation of Resin Layer)

One part by weight of polycarbonate (K-1300; Teijin Kasei K.K. . . . ) was dissolved in 10 parts by weight of THF. This solution was applied to the substrate coated with the a-Si type photosensitive layer Hd, and dried so that the resultant layer thickness could be 0.6 μm. Thus, a resin layer was formed.

(Formation of Surface Protective Layer)

Using the glow discharge decomposition equipment shown in FIG. 12, a surface protective layer was formed on the resin layer. First, the interior pressure of the reaction tank (733) was raised to a high vacuum degree of about $10^{-6}$ Torr, and then, the first, and second regulating valves (707), and (708) were opened, thereby respectively introducing the hydrogen gas from the first tank (701), and butadiene gas from the second tank (702) into the first, and second mass flow controller (713) and (714) under the output pressure of 1.5 Kg/cm$^2$. Then, by adjusting the graduations of the respective mass flow controllers, the flow rate of hydrogen gas was set to 300 sccm, and that of butadiene gas to 15 sccm. They passed into the mixer (731), and were introduced into the reaction chamber (733) through the main pipe (732). After the respective flow rates were stabilized, the pressure control valve (745) was adjusted to control the interior pressure of the reaction chamber (733) to 0.3 Torr.

The cylindrical substrate (752) was previously covered with a heat-shrinkable tubular polyvinyl chloride of about 90 mm diameter and about 300 mm length. The substrate was then subjected to a hot air treatment in an hot air oven to heat-shrink the tubular mesh to adhere to the substrate. In the shape of the mesh, the pores were about 100 μm in pore size, and the intervals between the pores were about 25 μm.

Next, the substrate (752) was fixed on the grounding electrode (735) inside the reaction chamber (733). The substrate (752) was heated to 50° C. from the ordinal temperature in about 15 minutes before the introduction of the gases. With the gas flow and the pressure stabilized, the low frequency power source (744) having been connected by the connection selecting switch (744) was turned on, and applied an electric power of 150 W (frequency 80 KHz) to the power applying electrode (736), thereby causing plasma polymerization reaction for about 4 minutes. Thus, a surface protective layer constituted of specks of an amorphous hydrocarbon layer of 0.15 μm thickness was formed on the substrate (752). The shapes of the specks were the same as those shown in FIG. 7. The circle specks of about 100 μm diameter were distributed at about 25 μm intervals on the substrate. After forming the layer, the power application was stopped, and the regulating valves other than that of hydrogen gas were closed, thereby introducing only hydrogen gas in the flow rate of 100 sccm into the reaction chamber (733). Then, the reaction chamber (733) was cooled to about 30° C. with the pressure maintained at 1 Torr. After that, the regulating valve (707) of hydrogen gas was closed, so that the gases of the reaction chamber (733) were sufficiently exhausted to collapse the vacuum state therein. After that, the photosensitive member with the resin layer and the surface protective layer was taken out therefrom.

(Characteristics)

The pencil hardness of the photosensitive member was measured based on the JIS-K-5400 standards. As a result, it was about 9H at the portions at which the specs were adhered.

The sensitivity characteristics were almost at the same level as those of Comparative Example 7. From this fact, it could be confirmed that the photosensitive member of the present invention did not lower the original sensitivity of the a-Si type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the resin layer and the surface protective layer did not occur. From this fact, it could be confirmed that the resin layer and the surface protective layer of the present invention were excellent in the adhesion property to a-Si type photosensitive members.

The obtained photosensitive member was mounted on the copying machine (EP-650Z; made by Minolta Camera K.K. . . . ), and actual copying operations were carried out. The resultant copied images were clear, and image flows did not occur in the copied images even when actual copying operations were carried out under the atmosphere of the relative humidity of 80% at 35 ° C.

Furthermore, the contact of the photosensitive member with developers, sheets of copying paper and cleaning members in the copying machine did not cause the peeling of the resin layer and the surface protective layer.

Still furthermore, the duplication tests were repeated 350,000 times under the ordinary room atmosphere. As a result, the copied images were clear throughout the tests. Moreover, even after the duplication tests were repeated 350,000 times, the thickness of the photosensitive layer was not decreased, and the flows of the copied images did not occur even under the atmosphere of the temperature of 35° C. and the relative humidity of 80%. From these facts, it could be confirmed that the surface protective layer of the present invention could improve the durability of photosensitive member without lowering the image quality.

EXAMPLE 9

(Formation of Resin Layer)

One part by weight of polycarbonate (K-1300; made by Teijin Kasei K.K. . . . ) was dissolved in 10 parts by weight of THF. This solution was applied to the substrate coated with the CdS/resin dispersion type photosensitive layer Ip, and dried so that the resultant layer thickness could be 0.1 μm. Thus, a resin layer was formed.

(Formation of Surface Protective Layer)

Using the glow discharge decomposition equipment shown in FIG. 11, a surface protective layer was formed on the resin layer. First, the interior pressure of the reaction tank (733) was raised to a high vacuum degree of about $10^{-6}$ Torr, and then, the first, and second regulating valves (707), and (708) were opened, thereby respectively introducing the hydrogen gas from the first tank (701), and the butadiene gas from the second tank (702) into the first, and second mass flow controller (713) and (714) under the output pressure of 1.5 Kg/cm$^2$. Then, by adjusting the graduations of the respective mass flow controllers, the flow rate of hydrogen gas was set to 300 sccm, and that of butadiene gas to 15 sccm. They passed into the mixer (731), and were introduced into the reaction chamber (733) through the main pipe (732). After the respective flow rates were stabilized, the pressure control valve (745)

was adjusted to control the interior pressure of the reaction chamber (733) to 0.5 Torr.

The substrate (752) was previously covered with a nickel sheet mask. In the shape of the sheet mask, the pores were 85 μm square and the intervals therebetween were about 15 μm.

Next, the substrate (752) was fixed on the grounding electrode (735) inside the reaction chamber (733). The substrate (752) was heated to 50° C. from the ordinal temperature in about 15 minutes before the introduction of the gases. With the gas flows and the pressure stabilized, the low frequency power source (741) having been connected by the connection selecting switch (744) was turned on, and applied an electric power of 200 W and frequency 2500 KHz to the power applying electrode (736), thereby causing plasma polymerization reaction for about 2 minutes. Thus, a surface protective layer constituted of specks of an amorphous hydrocarbon layer of 0.1 μm thickness was formed on the substrate (752). The shapes of the specks were the same as those shown in FIG. 9. The specks of about 85 μm square were distributed at about 15 μm intervals over the substrate. After forming the layer, the power application was stopped, and the regulating valves other than that of hydrogen gas were closed, thereby introducing only hydrogen gas in the flow rate of 100 sccm into the reaction chamber (733). Then, the reaction chamber (733) was cooled to about 30° C. with the pressure maintained at 1 Torr. After that, the regulating valve (707) of hydrogen gas was closed, so that the gases of the reaction chamber (733) were sufficiently exhausted to collapse the vacuum state therein. After that, the photosensitive member coated with the resin layer and the surface protective layer was taken out therefrom.

(Characteristics)

The pencil hardness of the photosensitive member was measured based on the JIS-K-5400 standards. As a result, it was about 7H at the portion at which the specks were adhered. From this fact, it could be confirmed that the surface protective layer of the present invention could improve the hardness of the photosensitive member.

The sensitivity characteristics were almost at the same level as those of Comparative Example 8. From this fact, it could be confirmed that the photosensitive member of the present invention did not lower the original sensitivity of the CdS/resin dispersion type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the resin layer and the surface protective layer did not occur. From this fact, it could be confirmed that the resin layer and the surface protective layer of the present invention were excellent in the adhesion property to CdS/resin dispersion type photosensitive members.

EXAMPLE 10

(Formation of Resin Layer)

One part by weight of polycarbonate (K-1300; made by Teijin Kasei K.K.. . . ) was dissolved in 10 parts by weight of THF. This solution was applied to the substrate coated with the CdS/resin dispersion type photosensitive layer Id, dried, and baked so that the resultant layer thickness could be 0.1 μm. Thus, a resin layer was formed.

(Formation of Surface Protective Layer)

Using the vapor deposition equipment shown in FIG. 14 a surface protective layer was formed on the resin layer.

First, a cylindrical substrate (503) was covered with a heat-shrinkable polyvinyl chloride tubular mesh of about 90 mm diameter and 300 mm length. The substrate was then subjected to a hot air treatment in a hot air oven to heat-shrink the tubular mesh at 50° C. to adhere to the substrate. In the shape of the mesh, the pores were about 100 μm in pore size and the intervals therebetween were about 25 μm.

Next, the substrate (503) was fixed on the substrate supporting member (502). A boat (504) was charged with the powder of silicon oxide or SiO.

Then, the interior pressure of a vacuum chamber (501) was adjusted to a high vacuum degree of about $10^{-7}$ Torr with the use of an exhaust pump (511), and electric power was applied to an electrode (506) to heat the boat (504) to 1,080° C. When the temperature of the boat (504) was stabilized, a motor (512) was driven to rotate the substrate (503) at about 10 rotations per min. With this state, a shutter (508) having been previously closed was opened for about 5 minutes by a rotation lever (510), while deposition was carried out under the atmosphere of a vacuum degree of about $10^{-5}$ Torr to form a surface protective layer constituted of the specks of a SiO layer of about 0.15 μm thickness on the substrate (503).

The shapes of the specks were the same as those shown in FIG. 7. The specks of about 100 μm in width(W) were distributed at about 25 μm intervals on the substrate. After forming the surface protective layer, the power application to the electrode (506) was stopped, and the gases of the vacuum chamber (501) were sufficiently exhausted to collapse the vacuum state therein. After that, the photosensitive member coated with the resin layer and the surface protective layer was taken out therefrom.

(Characteristics)

The pencil hardness of the photosensitive member was measured based on the JIS-K-5400 standards. As a result, it was about 7H at the portions at which the specks were adhered to the resin layer. From this fact, it could be confirmed that the surface protective layer of the present invention could improve the hardness of the photosensitive member.

The sensitivity characteristics were almost at the same level as that of Comparative Example 8. From this fact, it could be confirmed that the photosensitive member of the present invention did not lower the original sensitivity of the CdS/resin dispersion type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the resin layer and the surface protective layer did not occur. From this fact, it could be confirmed that the resin layer and the surface protective layer of the present invention were excellent in the adhesion property to Cds/resin dispersion type photosensitive members.

The obtained photosensitive member was mounted on the copying machine (EP-650Z; made by Minolta Camera K.K. . . . ) and actual copying operations were carried out. The resultant copied images were clear and image flows did not occur in the copied images even when actual copying operations were carried out under the atmosphere of the relative humidity of 80% at 35 ° C.

Furthermore, the contact of the photosensitive member with developers, sheets of copying paper and cleaning members in the copying machine did not cause the peeling of the resin layer and the surface protective layer.

Still furthermore, the duplication tests were repeated 300,000 times under the ordinary room atmosphere. As a result, the copied images were clear throughout the tests. Moreover, even after the duplication tests were repeated 300,000 times, the thickness of the photosensitive layer was not decreased, and the flows of the copied images did not occur even under the atmosphere of the temperature of 35° C. and the relative humidity of 80%. From these facts, it could be confirmed that the surface protective layer of the present invention could improve the durability of photosensitive member without lowering the image quality.

TABLE 1

| Exam. | photosensitive layer | photosensitive substrate | resinous layer (thickness) | surface protective layer material (thickness) | shape of speck | mask | equipment | pencil hardness | duplication times (1/10,000) |
|---|---|---|---|---|---|---|---|---|---|
| 1 | organic type | AP | polycarbonate (0.1 μm) | a-C (0.1 μm) | FIG. 9 | nickel sheet mask 43 μm square pore interval 11 μm | FIG. 11 | 6 H | — |
| 2 | | Ad | polycarbonate (0.06 μm) | a-C (0.15 μm) | FIG. 10 | 66 nylon tubular mesh W = 100 μm, L = 15 μm | FIG. 12 | 9 H | 35 |
| 3 | | Bd | Acrylic Meramine (0.06 μm) | SiO (0.15 μm) | FIG. 10 | 66 nylon tubular mesh W = 90 μm, L = 20 μm | FIG. 14 | 7 H | 30 |
| 4 | | Ed | Acrylic Meramine (0.06 μm) | $Al_2O_3$ (0.15 μm) | FIG 7 | heat-shrinkable vinyl chloride tubular mesh | FIG. 14 | 9 H | 30 |
| 5 | Se Type | Fp | Polycarbonate (0.06 μm) | SiO (0.15 μm) | FIG. 9 | nickel sheet mask 85 μm square pore interval 15 μm | FIG. 13 | 7 H | — |
| 6 | | Gd | Acrylic Melamine (0.06 μm) | a-C (0.1 μm) | FIG. 10 | 66 nylon tubular mesh W = 90 μm, L = 20 μm | FIG. 12 | 6 H | 30 |
| 7 | a-Si Type | Hp | Polycarbonate (0.1 μm) | $MgF_2$ (0.1 μm) | FIG. 9 | nickel sheet mask 85 μm square pore interval 15 μm | high frequency sputtering equipment | 7 H | — |
| 8 | | Hd | Polycarbonate (0.06 μm) | a-C (0.15 μm) | FIG. 7 | heat-shrinkable vinyl chloride tubular mesh pore diameter 100 μm interval 25 μm | FIG. 12 | 9 H | 35 |
| 9 | CdS/resin dispersion type | Ip | Polycarbonate (0.1 μm) | a-C (0.1 μm) | FIG. 9 | nickel sheet mask 85 μm square pore interval 15 μm | FIG. 11 | 7 H | — |
| 10 | | Id | Polycarbonate (0.1 μm) | SiO (0.15 μm) | FIG. 7 | heat-shrinkable pore diameter 100 μm interval 25 μm | FIG. 14 | 7 H | 30 |

TABLE 2

| Example | Production Conditions of a-C Surface Protective Layer: Gas Flow Rate (sccm) $C_4H_6$ | $CF_4$ | $H_2$ | Frequency (KHz) | Power (W) | Pressure (Torr) | Layer Forming Time (min.) | Thickness (μm) |
|---|---|---|---|---|---|---|---|---|
| 15 | 40 | | 80 | 1000 | 30 | 1 | 5 | 0.2 |
| 2 | 15 | | 300 | 80 | 150 | 0.3 | 4 | 0.15 |
| 8 | | | | | | | | |
| 12 | | | | | | | | |
| 16 | | | | | | | | |
| 1 | 15 | 90 | 300 | 80 | 150 | 0.5 | 2 | 0.1 |
| 6 | | | | | | | | |
| 11 | 15 | 90 | 300 | 100 | 100 | 1 | 5 | 0.2 |
| 9 | 15 | | 300 | 2500 | 200 | 0.5 | 2 | 0.1 |

TABLE 3

| Example | Composition | Production conditions of Metallic Compound Surface Protective, etc.: Process | Vacuum Degree (Torr) | Layer Forming Atmosphere | Deposition Source (Boat) (°C.) | Layer Forming Speed (μm/min.) | Layer Forming Time (min.) | Thickness (μm) |
|---|---|---|---|---|---|---|---|---|
| 3, 5 10 | SiO | Deposition | $10^{-5}$ | — | 1080 | 0.05 | 3 | 0.15 |

TABLE 3-continued

| Example | Composition | Production conditions of Metallic Compound Surface Protective, etc. | | | | | | |
|---|---|---|---|---|---|---|---|---|
| | | Process | Vacuum Degree (Torr) | Layer Forming Atmosphere | Deposition Source (Boat) (°C.) | Layer Forming Speed (μm/min.) | Layer Forming Time (min.) | Thickness (μm) |
| 13 | | | | | | | | |
| 4 | $Al_2O_3$ | Deposition | $10^{-5}$ | — | 1450 | 0.03 | 5 | 0.15 |
| 18 | | | | | | | | |
| 20 | | | | | | | | |
| 7 | $MgF_2$ | High | 0.1 | Ar | — | 0.02 | 5 | 0.1 |
| 14 | | Frequency | | | | | 10 | 0.2 |
| 21,24 | | Sputtering | | | | | | |
| 17 | SiO | High | $5 \times 10^{-2}$ | Ar | — | 0.015 | 10 | 0.15 |
| 19 | | Frequency | | | | | | |
| 22 | | Sputtering | | | | | | |
| 23 | $Al_2O_3$ | High Frequency Sputtering | $5 \times 10^{-2}$ | Ar | — | 0.01 | 15 | 0.15 |

Characteristics (Examples 1 to 10)

The following characteristic evaluation carried out with respect to the photosensitive members obtained in Examples 1 to 10 were summarized.

1. pencil hardness of surface protective layer
2. sensitivity characteristics
3. adhesion property after cyclic environmental test
4. clearness of copied images
5. copied image flow under high humidity at high temperature.
6. adhesion property of surface protective layer to photosensitive member after the actual copying operation
7. decrease of layer thickness of protective layer after actual copying operation
8. clearness of copied images after actual copying operations, and copied image flow under high humidity at high temperature.

The photosensitive members obtained in Examples 1 to 10 had no problems with respect to the above mentioned characteristics. From these facts, it could be confirmed that the surface protective layers of the present invention could improve the durability of organic type photosensitive members without lowering the characteristics and image qualities inherent thereto.

The photosensitive members obtained in Examples 1 to 10 were protected with layers of a high hardness without being lowered in the sensitivity characteristics thereof, and the surface protective layers constituted of specks were excellent in the adhesion properties with photosensitive members. Furthermore, clear copied images could be ensured, and flows of the copied images did not occur when actual copying operations were carried out with the copying machine using the photosensitive members of the present invention under the atmosphere of the high humidity. Still furthermore, the peeling of the surface protective layers, and the decrease in the thickness of the photosensitive members were not observed after the duplication tests were repeated 300,000 times, and flows in the copied images were not observed under the atmosphere of the high humidity.

EXAMPLE 11

Using the glow discharge decomposition equipment shown in FIG. 11, a surface protective layer was formed on a substrate Fp coated with a selenium type photosensitive layer. First, the interior pressure of the reaction tank (733) was raised to a high vacuum degree of about $10^{-6}$ Torr, and then, the first, second, and third regulating valves (707), (708), and (709) were opened, thereby respectively introducing the hydrogen gas from the first tank (701), the butadiene gas from the second tank (702), and the tetrafluoromethane gas from the third tank (703) into the first, second, and third mass flow controller (713, 714, and 715) under the output pressure of 1.5 Kg/cm$^2$. Then, by adjusting the graduations of the respective mass flow controllers, the flow rate of hydrogen gas was set to 300 sccm, that of butadiene gas to 15 sccm, and that of tetrafluoromethane gas to 90 sccm. They passed into the mixer (731), and were introduced into the reaction chamber (733) through the main pipe (732). After the respective flow rates were stabilized, the pressure control valve (745) was adjusted to control the interior pressure of the reaction chamber (733) to 1 Torr.

The substrate (752) was previously covered with a nickel sheet mask. In the shape of the sheet mask, the pores were 43 μm in square, and the intervals therebetween were about 11 μm.

Next, the substrate (752) was fixed on the grounding electrode (735) inside the reaction chamber (733). The substrate (752) was heated to 50° C. from the ordinal temperature in about 15 minutes before the introduction of the gases. With the gas flows and the pressure stabilized, the low frequency power source (741) having been connected by the connection selecting switch (744) was turned on, and applied an electric power of 100 W (frequency 100 KHz) to the power applying electrode (736), thereby causing plasma polymerization reaction for about 5 minutes. Thus, a surface protective layer constituted of specks of an amorphous hydrocarbon layer of 0.2 μm thickness was formed on the substrate (752). The shapes of the specks were the same as those shown in FIG. 9. The specks of about 43 μm square were distributed at about 11 μm intervals over the substrate. After forming the layer, the power application was stopped, and the regulating valves other than that of hydrogen gas were closed, thereby introducing only hydrogen gas in the flow rate of 100 sccm into the reaction chamber (733). Then, the reaction chamber (733) was cooled to about 30° C. with the pressure maintained at 1 Torr. After that, the regulating valve (707) of hydrogen gas was closed, so that the gases of the reaction chamber (733) were sufficiently exhausted to collapse the vacuum state therein. After that, the photosensitive member coated with the resin layer and the surface protective layer was taken out therefrom.

(Characteristics)

The pencil hardness of the photosensitive member was measured based on the JIS-K-5400 standards. As a result, it was about 6H at the portions at which the specks were adhered. From this fact, it could be confirmed that the surface protective layer of the present invention could improve the hardness of the photosensitive member.

The sensitivity characteristics were almost at the same level as those of Comparative Example 6. From this fact, it could be confirmed that the photosensitive member of the present invention did not lower the original sensitivity of the organic type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the resin layer and the surface protective layer did not occur. From this fact, it could be confirmed that the resin layer and the surface protective layer of the present invention were excellent in the adhesion property to organic type photosensitive members.

In this connection, the tables 2 to 4 show the production conditions, shapes, and characteristics of the surface protective layers prepared in Example 11. They show also the production conditions, shapes, and characteristics of the following examples 12 to 18.

TABLE 4

| Example | photosensitive layer | photosensitive substrate | surface protective layer material (thickness) | surface protective layer shape of speck | surface protective layer masking means used | surface protective layer equipment | pencil hardness | duplication times (1/10,000) |
|---|---|---|---|---|---|---|---|---|
| 11 | Se Type | Fp | a-C (0.2 μm) | FIG. 9 | nickel sheet mask 43 μm square pore interval 11 μm | FIG. 11 | 6 H | — |
| 12 | | Fp | a-C (0.15 μm) | FIG. 9 | nickel sheet mask 85 μm square pore interval 15 μm | FIG. 11 | 9 H | — |
| 13 | | Gp | SiO (0.15 μm) | FIG. 9 | SUS mesh 90 μm square pore interval 25 μm | FIG. 13 | 7 H | — |
| 14 | | Gp | $MgF_2$ (0.2 μm) | FIG. 9 | SUS mesh 90 μm square pore interval 25 μm | High Frequency Sputtering | 7 H | — |
| 15 | | Fd | a-C (0.2 μm) | FIG. 10 | 66 nylon tubular mesh W = 90 μm, L = 20 μm | FIG. 12 | 6 H | 30 |
| 16 | | Fd | a-C (0.15 μm) | FIG. 10 | 66 nylon tubular mesh W = 90 μm, L = 20 μm | FIG. 12 | 9 H | 35 |
| 17 | | Gd | SiO (0.15 μm) | FIG. 7 | heat shrinkable vinyl chloride tubular mesh pore diameter 100 μm, interval 25 μm | High Frequency Sputtering | 7 H | 30 |
| 18 | | Gd | $Al_2O_3$ (0.15 μm) | FIG. 7 | heat-shrinkable vinyl chloride tubular mesh pore diameter 100 μm, interval 25 μm | FIG. 14 | 9 H | 30 |

EXAMPLE 12

Using the mask for forming specks as shown in Table 4, a surface protective layer constituted of specks of an amorphous hydrocarbon layer of 0.15 μm thickness on the substrate Fp coated with the selenium type photosensitive layer in the same production procedures and conditions as those of Example 2. The shapes of the specks are the same as those shown in FIG. 9. The specks having about 85 μm square were distributed at about 15 μm intervals on the substrate.

EXAMPLE 13

Using the mask for forming specks as shown in Table 4, a surface protective layer constituted of specks of the silicon oxide (SiO) layer of 0.15 μm thickness on the substrate Gp coated with the selenium type photosensitive layer in the same production procedures and conditions as those of Example 3. The shapes of the specks are the same as those shown in FIG. 9. The specks having about 90 μm square were distributed at about 25 μm intervals on the substrate.

EXAMPLE 14

Using the mask for forming specks as shown in Table 4, a surface protective layer constituted of specks of a magnesium fluoride ($MgF_2$) layer of 0.2 μm thickness on the substrate Gp coated with the selenium type photosensitive layer in the same production procedures and conditions as those of Example 7. The shapes of the specks are the same as those shown in FIG. 9. The specks having about 90 μm square were distributed at about 25 μm intervals on the substrate.

EXAMPLE 15

Using the glow discharge decomposition equipment shown in FIG. 12, a surface protective layer was formed on the substrate Fd coated with the selenium type photosensitive layer. First, the interior pressure of the reaction tank (733) was raised to a high vacuum degree of about $10^{-6}$ Torr, and then, the first, and second regulating valves (707), and (708) were opened, thereby respectively introducing the hydrogen gas from the first tank (701), and the butadiene gas from the second tank (702) into the first, and second mass flow controller (713) and (714) under the output pressure of 1.5 $Kg/cm^2$. Then, by adjusting the graduations of the respective mass flow controllers, the flow rate of hydrogen gas was set to 80 sccm, and that of butadiene gas to 40 sccm. They passed into the mixer (731), and were introduced into the reaction chamber (733) through the main pipe (732). After the respective flow rates were stabilized, the pressure control valve (745) was adjusted to control the interior pressure of the reaction chamber (733) to 1 Torr.

The cylindrical substrate (752) was previously covered with 6,6-nylon stretchable tubular mesh of 50 mm diameter and about 300 mm length. In the shape of the mesh, the pores were about 90 μm in pore size, and the intervals therebetween were about 20 μm. Next, the cylindrical substrate (752) was fixed on the grounding electrode (735) inside the reaction chamber (733). The cylindrical substrate (752) was heated to 50° C. from the ordinal temperature in about 15 minutes before the introduction of the gases. With the gas flows and the pressure stabilized, the low frequency power source (741) having been connected by the connection selecting switch (744) was turned on, and applied an electric power of 30 W (frequency 1,000 KHz) to the power applying electrode (736), thereby causing plasma polymerization reaction for about 5 minutes. Thus, a surface protective layer constituted of the specks of an amorphous hydrocarbon layer of 0.2 μm thickness was formed on the cylindrical substrate (752). The shapes of the specks were the same as those shown in FIG. 10. The formless specks having the width (W) of about 90 μm were distributed at about 20 μm intervals on the substrate. After forming the layer, the power application was stopped, and the regulating valves other than that of hydrogen gas were closed, thereby introducing only hydrogen gas in the flow rate of 100 sccm into the reaction chamber (733). Then, the reaction chamber (733) was cooled to about 30° C. with the pressure maintained at 1 Torr. After that, the regulating valve (707) of hydrogen gas was closed, and the gases of the reaction chamber (733) were sufficiently exhausted to collapse the vacuum state therein. After that, the photosensitive member with the resin layer and the surface protective layer was taken out therefrom.

EXAMPLE 16

Using the mask for forming specks as shown in Table 4, a surface protective layer constituted of specks of an amorphous hydrocarbon layer of 0.15 μm thickness on the substrate Fd coated with the selenium type photosensitive layer in the same production procedures and conditions as those of Example 2. The shapes of the specks are the same as those shown in FIG. 10. The specks having the width (W) of about 90 μm were distributed at about 20 μm intervals on the substrate.

EXAMPLE 17

Using the sputtering deposition process of a high frequency of 13.56 MHz, a surface protective layer was formed on the substrate Gd coated with the selenium type photosensitive layer.

First, the cylindrical substrate was covered with a tubular heat-shrinkable polyvinyl chloride mesh of about 90 mm diameter and 300 mm length. The cylindrical substrate was then subjected to a hot air treatment at about 50° C. in an hot air oven to heat-shrink the mesh to adhere to the substrate. In the shape of the tubular mesh, the pores had about 100 μm in pore size and the intervals therebetween were 25 μm.

Next, the cylindrical substrate (503) was fixed on a grounding electrode in a vacuum chamber (not shown). A high frequency power applying electrode opposed thereto was covered with a SiO plate of about 5 mm thickness, which serves as a target.

Then, the interior pressure of a vacuum chamber was adjusted to a high vacuum degree of about $10^{-7}$ Torr with the use of a exhaust pump, and argon gas used for the sputtering process was introduced into the vacuum chamber to set the interior pressure to $5\times10^{-2}$ Torr. Next, an electric power of 200 W (frequency of 13.56 MHz) to the electrode to carry out the sputtering process for about 10 minutes. Thus, a surface protective layer constituted of specks of a SiO layer of about 0.15 μm thickness on the substrate.

The shapes of the specks were the same as those shown in FIG. 7. The cyclic specks of about 100 μm diameter were distributed at about 25 μm intervals on the substrate. After forming the surface protective layer, the power application to the electrode was stopped, and the gases of the vacuum chamber were sufficiently exhausted to collapse the vacuum state therein. After that, the photosensitive member coated with the resin layer and the surface protective layer was taken out therefrom.

EXAMPLE 18

Using the mask for forming specks as shown in Table 4, a surface protective layer constituted of the specks of an aluminum oxide ($Al_2O_3$) layer of 0.15 μm thickness on the substrate Gd coated with the selenium type photosensitive layer in the same production procedures and conditions as those of Example 4. The shapes of the specks are the same as those shown in FIG. 7. The cyclic specks of about 100 μm in pore size were distributed at about 25 μm intervals on the substrate.

Characteristics (Examples 11 to 18)

The following characteristic evaluation was carried out with respect to the photosensitive members obtained in Examples 11 to 18.

1. pencil hardness of surface protective layer
2. sensitivity characteristics
3. adhesion property after cyclic environmental test
4. clearness of copied images
5. copied image flow under high humidity at high temperature.
6. adhesion property of surface protective layer to photosensitive member after the actual copying operation
7. decrease of layer thickness of protective layer after actual copying operation
8. clearness of copied images after actual copying operations, and copied image flow under high humidity at high temperature.

The photosensitive members obtained in Examples 11 to 18 had no problems with respect to the above mentioned characteristics. From these facts, it could be confirmed that the surface protective layers of the present invention could improve the durability of selenium type photosensitive members without lowering the characteristics and image qualities inherent thereto.

The photosensitive members obtained in Examples 11 to 18 were protected with layers of a high hardness (refer to Table 4) without being lowered in the sensitivity characteristics of the selenium type photosensitive layers, and the surface protective layers constituted of specks were excellent in the adhesion properties with the selenium type photosensitive layers. Furthermore, clear copied images could be ensured, and flows of the copied images did not occur when actual copying operations were carried out with the copying machine using the photosensitive members of the present invention (refer to Examples 15 to 18) under the atmosphere of the high humidity. Still furthermore, the peeling of the surface protective layers, and the decrease in the thickness of the photosensitive members were not observed after the duplication tests were repeated 300,000 times (refer to Examples 15, 17, and 18) or 350,000 times (refer to Example 16), and flows of the copied images were not observed under the atmosphere of the high humidity.

EXAMPLE 19

Using the mask for forming specks as shown in Table 5, a surface protective layer constituted of the specks of a silicon oxide (SiO) layer of 0.15 μm thickness on the substrate Ap coated with the organic photosensitive layer in the same production procedures and conditions as those of Example 17. The shapes of the specks are the same as those shown in FIG. 9. The specks having about 43 μm square were distributed at about 11 μm intervals on the substrate.

silicon oxide (SiO) layer of 0.15 μm thickness on the substrate Ad coated with the organic type photosensitive layer in the same production procedures and conditions as those of Example 17. The shapes of the specks are the same as those shown in FIG. 10. The specks having the width (W) of about 90 μm were distributed at about 20 μm intervals on the substrate.

EXAMPLE 23

Using the sputtering deposition process of a high frequency of 13.56 MHz, a surface protective layer was formed on the substrate Cd coated with the organic type photosensitive layer.

First, the cylindrical substrate was covered with a nylon stretchable tubular mesh of about 50 mm diameter and 300 mm length. In the shape of the tubular mesh, the pores were of about 90 μm in pore size and the intervals therebetween were 20 μm.

Next, the cylindrical substrate was fixed on a grounding electrode in a vacuum chamber (not shown). A high frequency power applying electrode opposed thereto

TABLE 5

| | photosensitive | | surface protective layer | | | | | |
|---|---|---|---|---|---|---|---|---|
| Exam. | layer | substrate | material (thickness) | shape of speck | mask | equipment | pencil hardness | duplication times (1/10,000) |
| 19 | Organic Type | AP | SiO (0.15 μm) | FIG. 9 | nickel sheet mask 43 μm square pore interval 11 μm | High Frequency Sputtering | 7 H | — |
| 20 | | Cp | $Al_2O_3$ (0.15 μm) | FIG. 9 | nickel sheet mask 85 μm square pore interval 15 μm | FIG. 13 | 9 H | — |
| 21 | | Dp | $MgF_2$ (0.2 μm) | FIG. 9 | SUS mesh 90 μm square pore interval 25 μm | High Frequency Sputtering | 7 H | — |
| 22 | | Ad | SiO (0.15 μm) | FIG. 10 | 66 nylon tubular mesh W = 90 μm, L = 20 μm | High Frequency Sputtering | 7 H | 30 |
| 23 | | Cd | $Al_2O_3$ (0.15 μm) | FIG. 10 | 66 nylon tubular mesh W = 90 μm, L = 20 μm | High Frequency Sputtering | 9 H | 30 |
| 24 | | Dd | $MgF_2$ (0.2 μm) | FIG. 7 | heat-shrinkable vinyl chloride tubular mesh pore diameter 100 μm interval 25 μm | High Frequency Sputtering | 7 H | 30 |

EXAMPLE 20

Using the mask for forming specks as shown in Table 5, a surface protective layer constituted of specks of an aluminum oxide ($Al_2O_3$) layer of 0.15 μm thickness on the substrate Cp coated with the organic type photosensitive layer in the same production procedures and conditions as those of Example 4. The shapes of the specks are the same as those shown in FIG. 9. The specks having about 85 μm square were distributed at about 15 μm intervals on the substrate.

EXAMPLE 21

Using the mask for forming specks as shown in Table 5, a surface protective layer constituted of specks of a magnesium fluoride ($MgF_2$) layer of 0.2 μm thickness on the substrate Dp coated with the organic type photosensitive layer in the same production procedures and conditions as those of Example 7. The shapes of the specks are the same as those shown in FIG. 9. The specks having about 100 μm square were distributed at about 25 μm intervals on the substrate.

EXAMPLE 22

Using the mask for forming specks as shown in Table 5, a surface protective layer constituted of specks of a was covered with an aluminum oxide ($Al_2O_3$) plate of about 5 mm thickness, which serves as a target.

Then, the interior pressure of the vacuum chamber was adjusted to a high vacuum degree of about $10^{-7}$ Torr with the use of an exhaust pump, and argon gas used for the sputtering process was introduced into the vacuum chamber to adjust the interior pressure to $5\times10^{-2}$ Torr. Next, an electric power of 200 W (frequency of 13.56 MHz) to the electrode to carry out the sputtering process for about 15 minutes. Thus, a surface protective layer constituted of specks of an $Al_2O_3$ layer of about 0.15 μm thickness on the substrate.

The shapes of the specks were the same as those shown in FIG. 10. The cyclic specks having the width (W) of about 90 μm were distributed at about 20 μm intervals on the substrate. After forming the surface protective layer, the power application to the electrode was stopped, and the gases of the vacuum chamber were sufficiently exhausted to collapse the vacuum state therein. After that, the photosensitive member coated with the resin layer and the surface protective layer was taken out therefrom.

EXAMPLE 24

Using the mask for forming specks as shown in Table 5, a surface protective layer constituted of specks of a magnesium fluoride ($MgF_2$) layer of 0.2 μm thickness on the substrate Dd coated with the organic type photosensitive layer in the same production procedures and conditions as those of Example 7. The shapes of the specks are the same as those shown in FIG. 7. The cyclic specks of about 100 μm diameter were distributed at about 25 μm intervals on the substrate.

Characteristics (Examples 19 to 24)

The following characteristics evaluation was carried out with respect to the photosensitive members obtained in Examples 19 to 24 in the same manner as that of Example 1.

1. pencil hardness of surface protective layer
2. sensitivity characteristics
3. adhesion property after cyclic environmental test
4. clearness of copied images
5. copied image flow under high humidity at high temperature.
6. adhesion property of surface protective layer to photosensitive member after the actual copying operation
7. decrease of layer thickness of protective layer after actual copying operation
8. clearness of copied images after actual copying operations, and copied image flow under high humidity at high temperature.

The photosensitive members obtained in Examples 19 to 24 had no problems with respect to the above mentioned characteristics. From these facts, it could be confirmed that the surface protective layers of the present invention could improve the durability of organic type photosensitive members without lowering the characteristics and image qualities inherent thereto.

The photosensitive members obtained in Examples 19 to 24 were protected with layers of a high hardness to be improved in the hardness without being lowered in the sensitivities and characteristics thereof(refer to Table 5), and the surface protective layers constituted of specks were excellent in the adhesion properties to photosensitive members. Furthermore, clear copied images could be ensured when actual copying operations were carried out with the copying machine using the photosensitive members of the present invention (refer to Examples 22 to 24), and flows of the copied images did not occur when copied under the atmosphere of the high humidity. Still furthermore, the peeling of the surface protective layers, and the decrease in the thickness of the photosensitive members were not observed after the duplication tests were repeated 300,000 times, and flows of the copied images were not observed when such tests were repeated under the atmosphere of the high humidity.

Photosensitive members with resin layers and surface protective layers on the photosensitive layers (Comparative Examples 9–12) and photosensitive members with surface protective layers on the photosensitive layers (Comparative Examples 13–16)were prepared in a manner similar to Example 2 (Comparative Example 9), Example 6 (Comparative Example 10), Example 8 (Comparative Example 11), Example 10 (Comparative Example 12), Example 16 (Comparative Example 13), Example 18 (Comparative Example 14), Example 22 (Comparative Example 15), and Example 24 (Comparative Example 16), except that uniform surface protective layers covering all over the photosensitive layers or the resin layers. In these Comparative Examples, the masks such as meshes were not covered with on the substrate when the surface protective layers were formed.

Characteristics (Comparative Examples 9 to 16)

The following characteristic evaluation was carried out with respect to the photosensitive members obtained in Comparative Examples 9 to 16).

1. pencil hardness of surface protective layer
2. sensitivity characteristics
3. adhesion property after cyclic environmental test
4. clearness of copied images
5. copied image flow under high humidity at high temperature.
6. adhesion property of surface protective layer to photosensitive member after the actual copying operation
7. decrease of layer thickness of protective layer after actual copying operation
8. clearness of copied images after actual copying operations.
9. copied image flow under high humidity at high temperature.

As shown in Table 6, the photosensitive members obtained in Comparative Examples 9 to 16 had no problems with respect to the above mentioned items 1 to 8. Flows of the copied images, however, occurred after actual duplication tests were repeated under the atmosphere where the temperature was 30° C. and the humidity was 80%: in the cases of Comparative Examples 9, 11, and 13, flows of the copied images occurred after 100,000 times of duplication tests; in the case of Comparative Example 15, they occurred after 150,000 times of duplication tests; in the cases of Comparative Examples 12, 14, and 16, they occurred after 80,000 times of duplication tests; and in the case of Comparative Example 15, they occurred after 70,000 times of duplication tests. From these facts, it could be confirmed that the photosensitive members of the present invention, which were provided with surface protective layers constituted of the distributed of specks, were also excellent in the durability with respect to copied image qualities.

In addition, Table 6 shows the production conditions, and the characteristics of the photosensitive members obtained in Comparative Examples 1 to 16. The flows of the copied images formed under high humidity atmosphere after duplication tests were evaluated by the following marks:

. . . The copied images were clear without any flows therein.

. . . Flows occurred partially in the copied images.

. . . Flows occurred notably in the almost entire copied images.

TABLE 6

| | Production Conditions | | | | | | Characteristics | | | |
|---|---|---|---|---|---|---|---|---|---|---|
| | Photosensitive | | Resinous | Surface Protective Layer (Uniform Film Type) | | | | Decrease in Thickness | Flows in | Noises of |
| Com. Exam. | Layer | Sub-strate | Layer (thickness) | Material (thickness) | Equipment | Pencil Hardness | Duplication Times (1/1,000) | (μm) | Images | Images |
| | | | | | | | | After Durability Tests | | |
| 1 | Organic | Ap, Ad | | | | 5 B | 5 | about 1 μm | | none |

TABLE 6-continued

| Com. Exam. | Photosensitive Layer | Photosensitive Sub-strate | Production Conditions: Resinous Layer (thickness) | Surface Protective Layer (Uniform Film Type) Material (thickness) | Surface Protective Layer (Uniform Film Type) Equipment | Pencil Hardness | Characteristics: Duplication Times (1/1,000) | Decrease in Thickness (μm) | Flows in Images | Noises of Images |
|---|---|---|---|---|---|---|---|---|---|---|
| | | | | | | | | After Durability Tests | | |
| 2 | Type | Bp, Bd | | | | B | 8 | about 1 μm | | none |
| 3 | | Cp, Cd | | | | 5 B | 4 | about 1 μm | | none |
| 4 | | Dp, Dd | | | | 5 B | 5 | about 1 μm | | none |
| 5 | | Ep, Ed | | | | B | 10 | about 1 μm | | none |
| 6 | Se Type | Gp, Gd | | | | H | 100 | none | | white stripes |
| 7 | a-Si Type | Hp, Hd | | | | Bickers 1800 | 20 | — | X | none |
| 8 | Cds/Resin Dispersion Type | Ip, Id | | | | B | — | none | X (initial) | none |
| 9 | Organic Type | Ad | Poly Carbonate (0.06 μm) | a-C (0.15 μm) | FIG. 12 | 9 H | 100 | none | Δ | none |
| 10 | Se Type | Gd | Acryl Meramine (0.06 μm) | a-C (0.1 μm) | FIG. 12 | 6 H | 150 | none | Δ | none |
| 11 | a-Si Type | Hd | Poly Carbonate (0.06 μm) | a-C (0.15 μm) | FIG. 12 | 9 H | 100 | none | Δ | none |
| 12 | Cds/Resin Dispersion Type | Id | Poly Carbonate (0.1 μm) | SiO (0.15 μm) | FIG. 14 | 7 H | 80 | none | X | none |
| 13 | Se Type | Fd | | a-C (0.15 μm) | FIG. 12 | 9 H | 100 | none | Δ | none |
| 14 | | Gd | | $Al_2O_3$ (0.15 μm) | FIG. 14 | 9 H | 80 | none | X | none |
| 15 | Organic Type | Ad | | SiO (0.15 μm) | RF Sputtering Process | 7 H | 70 | none | X | none |
| 16 | | Dd | | $MgF_2$ (0.2 μm) | RF Sputtering Process | 7 H | 80 | none | X | none |

EXAMPLE 25

Using the glow discharge decomposition equipment shown in FIG. 11, a surface protective layer was formed on a photosensitive member. The substrate used was the one coated with the organic photosensitive layer Ap.

First, the interior pressure of the reaction tank (733) was raised to a high vacuum degree of about $10^{-6}$ Torr, and then, the first, and second regulating valves (707), and (708) were opened, thereby respectively introducing the hydrogen gas from the first tank (701), and the butadiene gas from the second tank (702) into the first, and second mass flow controller (713) and (714) under the output pressure of 1.0 Kg/cm$^2$. Then, by adjusting the graduations of the respective mass flow controllers, the flow rate of hydrogen gas was set to 300 sccm, and that of butadiene gas to 15 sccm. They passed into the mixer (731), and were introduced into the reaction chamber (733) through the main pipe (732). After the respective flow rates were stabilized, the pressure control valve (745) was adjusted to control the interior pressure of the reaction chamber (733) to 0.5 Torr.

The substrate (752) was previously covered with a stainless mesh sheet. The shape of the mesh sheet was shown in FIG. 9. In the mesh, the pores were about 65 μm square and about 18 μm intervals therebetween.

Next, the substrate (752) was fixed on the grounding electrode (735) inside the reaction chamber (733). The substrate (752) was heated to 50° C. from the ordinal temperature in about 15 minutes before the introduction of the gases. With the gas flows and the pressure stabilized, the low frequency power source (741) having been connected by the connection selecting switch (744) was turned on, and applied an electric power of 150 W (frequency 80 KHz) to the power applying electrode (736), thereby causing plasma polymerization reaction for about 4 minutes. Thus, a surface protective layer constituted of specks of an amorphous hydrocarbon layer of 0.2 μm thickness was formed on the substrate (752). The specks of about 65 μm square were distributed at about 18 μm intervals over the substrate (752). After forming the layer, the power application was stopped, and the regulating valves other than that of hydrogen gas were closed, thereby introducing only hydrogen gas in the flow rate of 200 sccm into the reaction chamber (733). Then, the reaction chamber (733) was cooled to about 30° C. in about 30 minutes with the pressure maintained at 10 Torr. After that, the regulating valve (707) of hydrogen gas was closed, so that the gases of the reaction chamber (733) were entirely exhausted to collapse the vacuum state therein. After that, the photosensitive member coated with the surface protective layer was taken out therefrom.

(Characteristics)

The pencil hardness of the photosensitive member was measured based on the JIS-K-5400 standards. As a result, it was about 6H at the portion at which the specks were adhered. From this fact, it could be confirmed that the surface protective layer of the present invention could improve the hardness of the photosensitive member.

The sensitivity characteristics were almost at the same level as those of Comparative Example 1. From this fact, it could be confirmed that the photosensitive member of the present invention did not lower the original sensitivity of the organic type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the surface protective layer did not occur. From this fact, it could be confirmed that the surface protective layer of the present invention were excellent in the adhesion property to organic type photosensitive members. In this connection, Table 7 shows the production conditions, the shape, and the characteristics of the surface protective layer obtained in Example 25. It also shows the production conditions, the shapes, and the characteristics of the following Examples 26 to 32, and those of Comparative Examples 17 and 18.

TABLE 7

| | | | Production Conditions of a-C Surface Protective Layer | | | | | | | | | |
|---|---|---|---|---|---|---|---|---|---|---|---|---|
| | Speck | Process of Forming Specks | $C_4H_6$ | $C_3H_6$ | $CF_4$ | $C_2F_4$ | $H_2$ | Frequency (KHz) | Power (W) | Pressure (Torr) | Layer Forming Time (min.) | Thickness (μm) |
| Exam. | | | | | | | | | | | | |
| 25 | FIG. 9 | SUS mesh square 65 μm interval 18 μm | 15 | | | | 300 | 80 | 150 | 0.5 | 4 | 0.2 |
| 26 | FIG. 9 | nickel sheet mask square 85 μm interval 15 μm | 40 | | | | 80 | 1000 | 30 | 1 | 5 | 0.2 |
| 27 | FIG. 9 | nickel sheet mask square 43 μm interval 11 μm | 15 | | | | 300 | 80 | 150 | 0.3 | 4 | 0.15 |
| 28 | FIG. 9 | SUS mesh square 90 μm interval 25 μm | 15 | | 90 | | | 80 | 150 | 0.5 | 1 | 0.15 |
| 29 | FIG. 10 | 66 nylon tubular mesh W = 100 μm L = 15 μm | 70 | | | 50 | | 80 | 150 | 0.5 | 1.5 | 0.3 |
| 30 | FIG. 10 | 66 nylon tubular mesh max. width W = 90 μm L = 20 μm | | 20 | | | 50 | 80 | 150 | 0.5 | 5 | 0.15 |
| 31 | FIG. 7 | heat-shrinkable vinyl chloride tubular mesh diameter 70 μm interval 15 μm | 15 | | 90 | | 300 | 100 | 100 | 0.5 | 3 | 0.2 |
| 32 | FIG. 7 | heat-shrinkable vinyl chloride tubular mesh diameter 100 μm interval 25 μm | 15 | | | | 300 | 80 | 100 | 0.22 | 8 | 0.2 |
| Com. Exam. | | | | | | | | | | | | |
| 17 | | uniform coating | | 20 | | | 50 | 80 | 150 | 0.5 | 5 | 0.15 |
| 18 | | uniform coating | 15 | | 90 | | 300 | 100 | 100 | 0.5 | 3 | 0.2 |

| | Substrate | Pencil Hardness (H) | Duplication Times (1/10,000) | Shape of Sample | Equipment |
|---|---|---|---|---|---|
| Exam. | | | | | |
| 25 | Ap | 6 | — | plate | FIG. 11 |
| 26 | Bp | 6 | — | plate | FIG. 11 |
| 27 | Ep | 9 or more | — | plate | FIG. 11 |
| 28 | Cp | 6 | — | plate | FIG. 11 |
| 29 | Ad | 9 | 35 | tube | FIG. 12 |
| 30 | Dd | 6 | 30 | tube | FIG. 12 |
| 31 | Bd | 6 | 30 | tube | FIG. 12 |
| 32 | Ed | 9 or more | 35 | tube | FIG. 12 |
| Com. Exam. | | | | | |
| 17 | Dd | 6 | 15 | tube | FIG. 12 |
| 18 | Bd | 6 | 10 | tube | FIG. 12 |

EXAMPLE 26

Using the glow discharge decomposition equipment shown in FIG. 11, a surface protective layer was formed on a photosensitive layer. The substrate used was the one coated with the organic photosensitive layer Bp.

First, the interior pressure of the reaction tank (733) was increased to a high vacuum degree of about $10^{-6}$ Torr, and then, the first, and second regulating valves (707), and (708) were opened, thereby respectively introducing the hydrogen gas from the first tank (701), and the butadiene gas from the second tank (702) into the first, and second mass flow controller (713) and (714) under the output pressure of 1.0 Kg/cm$^2$. Then, by adjusting the graduations of the respective mass flow controllers, the flow rate of hydrogen gas was set to 80 sccm, and that of butadiene gas to 40 sccm. They passed into the mixer (731), and were introduced into the reaction chamber (733) through the main pipe (732). After the respective flow rates were stabilized, the pressure control valve (745) was adjusted to control the interior pressure of the reaction chamber (733) to 1 Torr.

The substrate (752) was previously covered with a nickel sheet mask. The shape of the sheet mask was shown in FIG. 9, in which the pores were about 85 μm square and the interval therebetween were about 15 μm.

Next, the substrate (752) was fixed on the grounding electrode (735) inside the reaction chamber (733). The substrate (752) was heated to 50° C. from the ordinal temperature in about 15 minutes before the introduction of the gases. With the gas flows and the pressure stabilized, the low frequency power source (741) having been connected by the connection selecting switch (744) was turned on, and applied an electric power of 30 W (frequency 1 MHz). to the power applying electrode (736), thereby causing plasma polymerization reaction for about 5 minutes. Thus, a surface protective layer constituted of the specks of an amorphous hydrocarbon layer of 0.2 μm thickness was formed on the substrate (752). The specks of about 80 μm square distributed at about 15 μm intervals. After forming the layer, the power application was stopped, and the regulating valves other than that of hydrogen gas were closed, thereby introducing only hydrogen gas in the flow rate of 200 sccm into the reaction chamber (733). Then, the reaction chamber (733) was cooled to about 30° C. with the pressure maintained at 10 Torr. After that, the regulating valve (707) of hydrogen gas was closed, so that the gases of the reaction chamber (733) were sufficiently exhausted to collapse the vacuum state therein. After that, the photosensitive member with the surface protective layer was taken out therefrom.

(Characteristics)

The pencil hardness of the photosensitive member was measured based on the JIS-K-5400 standards. As a result, it was about 6H at the portions at which specks were adhered. From this fact, it could be confirmed that the surface protective layer of the present invention could improve the hardness of the photosensitive member.

The sensitivity characteristics was almost at the same level as those of Comparative Example 2. From this fact, it could be confirmed that the surface protective layer of the present invention did not lower the original sensitivity of the organic type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the surface protective layer did not occur. From this fact, it could be confirmed that the surface protective layer of the present invention were excellent in the adhesion property to organic type photosensitive members.

EXAMPLE 27

Using the glow discharge decomposition equipment shown in FIG. 11, a surface protective layer was formed on a photosensitive layer. The substrate used was the one coated with the organic photosensitive layer Ep.

First, the interior pressure of the reaction tank (733) was increased to a high vacuum degree of about $10^{-6}$ Torr, and then, the first, and second regulating valves (707), and (708) were opened, thereby respectively introducing the hydrogen gas from the first tank (701), and the butadiene gas from the second tank (702) into the first, and second mass flow controllers (713) and (714) under the output pressure of 1.0 Kg/cm$^2$. Then, by adjusting the graduations of the respective mass flow controllers, the flow rate of hydrogen gas was set to 300 sccm, and that of butadiene gas to 15 sccm. They passed into the mixer (731), and were introduced into the reaction chamber (733) through the main pipe (732). After the respective flow rates were stabilized, the pressure control valve (745) was adjusted to control the interior pressure of the reaction chamber (733) to 0.3 Torr.

The substrate (752) was previously covered with a nickel sheet mask. The shape of the sheet mask was shown in FIG. 9, in which the pores were about 43 μm square and the intervals therebetween were about 11 μm.

Next, the substrate (752) was fixed on the grounding electrode (735) inside the reaction chamber (733). The substrate (752) was heated to 50° C. from the ordinal temperature in about 15 minutes before the introduction of the gases. With the gas flows and the pressure stabilized, the low frequency power source (741) having been connected by the connection selecting switch (744) was turned on, and applied an electric power of 150 W (frequency 80 KHz) to the power applying electrode (736), thereby causing plasma polymerization reaction for about 4 minutes. Thus, a surface protective layer constituted of the specks of an amorphous hydrocarbon layer of 0.15 μm thickness was formed on the substrate (752). The specks of about 43 μm square distributed at about 11 μm intervals over of the surface of the photosensitive layer. After forming the layer, the power application was stopped, and the regulating valves other than that of hydrogen gas were closed, thereby introducing only hydrogen gas in the flow rate of 200 sccm into the reaction chamber (733). Then, the reaction chamber (733) was cooled to about 30° C. with the pressure maintained at 10 Torr. After that, the regulating valve (707) of hydrogen gas was closed, so that the gases of the reaction chamber (733) were sufficiently exhausted to collapse the vacuum state therein. After that, the photosensitive member coated with the surface protective layer was taken out therefrom.

(Characteristics)

The pencil hardness of the photosensitive member was measured based on the JIS-K-5400 standards. As a result, it was about 9H or more at the portions at which specks were adhered. From this fact, it could be confirmed that the surface protective layer of the present invention could improve the hardness of the photosensitive member.

The sensitivity characteristics were almost at the same level as those of Comparative Example 5. From this fact, it could be confirmed that the surface protective layer of the present invention did not lower the original sensitivity of the organic type photosensitive member.

Moreover, this photosensitive member was left for 6 hours in such an environment where a low temperature and low humidity atmosphere (the temperature of 10°

C. and the relative humidity of 30%) and a high temperature and high humidity atmosphere (the temperature of 50° C. and the relative humidity of 90%) were alternated at 30-minute intervals. As a result, the peeling or cracks of the surface protective layer did not occur. From this fact, it could be confirmed that the surface protective layer of the present invention was excellent in the adhesion property to organic type photosensitive members.

EXAMPLE 28

Using the glow discharge decomposition equipment shown in FIG. 11, a surface protective layer was formed on a photosensitive layer. The substrate used was the one coated with the organic photosensitive layer Cp.

First, the interior pressure of the reaction tank (733) was increased to a high vacuum degree of about $10^{-6}$ Torr, and then, the first, and second regulating valves (707), and (708) were opened, thereby respectively introducing the tetrafluoromethane gas from the first tank (701), and the butadiene gas from the second tank (702) into the first, and second mass flow controllers (713) and (714) under the output pressure of 1.0 Kg/cm$^2$. Then, by adjusting the graduations of the respective mass flow controllers, the flow rate of tetrafluoromethane fluoride gas was set to 90 sccm, and that of butadiene gas to 15 sccm. They passed into the mixer (731), and were introduced into the reaction chamber (733) through the main pipe (732). After the respective flow rates were stabilized, the pressure control valve (745) was adjusted to control the interior pressure of the reaction chamber (733) to 0.5 Torr.

The substrate (752) was previously covered with a stainless mesh sheet. The shape of the sheet mask was shown in FIG. 9, in which the pores were about 90 μm square and the intervals therebetween were about 25 μm.

Next, the substrate (752) was fixed on the grounding electrode (735) inside the reaction chamber (733). The substrate (752) was heated to 50° C. from the ordinal temperature in about 15 minutes before the introduction of the gases. With the gas flows and the pressure stabilized, the low frequency power source (741) having been connected by the connection selecting switch (744) was turned on, and applied an electric power of 150 W (frequency 80 KHz) to a power applying electrode (736), thereby causing plasma polymerization reaction for about 1 minute. Thus, a surface protective layer constituted of the specks of an amorphous hydrocarbon layer of 0.15 μm thickness was formed on the substrate (752). The specks of about 90 μm square were distributed at about 25 μm intervals over the photosensitive layer. After forming the layer, the power application was stopped, and the regulating valves other than that of hydrogen gas were closed, thereby introducing only hydrogen gas in the flow rate of 200 sccm into the reaction chamber (733). Then, the reaction chamber (733) was cooled to about 30° C. in about 30 minutes with the pressure maintained at 10 Torr. After that, the regulating valve (707) of hydrogen gas was closed, so that the gases of the reaction chamber (733) were sufficiently exhausted to collapse the vacuum state therein. After that, the photosensitive member coated with the surface protective layer was taken out therefrom.

(Characteristics)

The pencil hardness of the photosensitive member was measured based on the JIS-K-5400 standards. As a result, it was about 6H at the portion at which the specks were adhered. From this fact, it could be confirmed that the surface protective layer of the present invention could improve the hardness of the photosensitive member.

The sensitivity characteristics were almost at the same level as those of Comparative Example 3. From this fact, it could be confirmed that the surface protective layer of the present invention did not lower the original sensitivity of the organic type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the surface protective layer did not occur. From this fact, it could be confirmed that the surface protective layer of the present invention was excellent in the adhesion property to organic type photosensitive members.

EXAMPLE 29

Using the glow discharge decomposition equipment shown in FIG. 12, a surface protective layer was formed on a photosensitive layer. The substrate used was the one coated with the organic photosensitive layer Ad.

First, the interior pressure of the reaction tank (733) was raised to a high vacuum degree of about $10^{-6}$ Torr, and then, the first, and second regulating valves (707), and (708) were opened, thereby respectively introducing the tetrafluoroethylene gas from the first tank (701), and the butadiene gas from the second tank (702) into the first, and second mass flow controllers (713) and (714) under the output pressure of 1.0 Kg/cm$^2$. Then, by adjusting the graduations of the respective mass flow controllers, the flow rate of the tetrafluoroethylene gas was set to 50 sccm, and that of butadiene gas to 70 sccm. They passed into the mixer (731), and were introduced into the reaction chamber (733) through the main pipe (732). After the respective flow rates were stabilized, the pressure control valve (745) was adjusted to control the interior pressure of the reaction chamber (733) to 0.5 Torr.

The substrate (752) was previously coated with the organic photosensitive layer (Ad).

The cylindrical substrate (752) was covered with 6,6-nylon tubular stretchable mesh of about 50 mm diameter, and about 300 mm length. The shape of the mesh was the same as shown in FIG. 10, in which the pores were about 100 μm in pore size and the intervals therebetween were about 15 μm.

Next, the substrate (752) was fixed on the grounding electrode (735) inside the reaction chamber (733). The substrate (752) was heated to 50° C. from the ordinal temperature in about 15 minutes before the introduction of the gases. With the gas flows and the pressure stabilized, the low frequency power source (741) having been connected by the connection selecting switch (744) was turned on, and applied an electric power of 150 W (frequency 80 KHz) to the power applying electrode (736), thereby causing plasma polymerization reaction for about 1.5 minutes. Thus, a surface protective layer constituted of the specks of an amorphous hydrocarbon layer of 0.3 μm thickness was formed on the substrate (752). The specks of width (W) of about 100 μm were distributed at about 15 μm intervals over the photosensitive layer. After forming the layer, the power application was stopped, and the regulating valves other than that of hydrogen gas were closed, thereby introducing only hydrogen gas in the flow rate of 200 sccm into the reaction chamber (733). Then, the reaction chamber (733) was cooled to about 30° C. with the pressure maintained at 10 Torr in about 30 minutes. After that, the regulating valve of hydrogen gas was closed, and the gases of the reaction chamber (733) were sufficiently exhausted to collapse the vacuum state therein. After that, the photosensitive member with the surface protective layer was taken out therefrom.

(Characteristics)

The pencil hardness of the photosensitive member was measured based on the JIS-K-5400 standards. As a result, it was about 9H at the portions at which the specks were adhered. From this fact, it could be confirmed that the surface protective layer of the present invention could improve the hardness of the photosensitive member.

The sensitivity characteristics were almost at the same level as those of Comparative Example 1. From this fact, it could be confirmed that the surface protective layer of the present invention did not lower the original sensitivity of the organic type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the surface protective layer did not occur. From this fact, it could be confirmed that the surface protective layer of the present invention was excellent in the adhesion property to organic type photosensitive members.

The obtained photosensitive member was mounted on the copying machine (EP-650Z; made by Minolta Camera K.K. . . . ), and actual copying operations were carried out. The resultant copied images were clear and image flows did not occur in the copied images even when actual copying operations were carried out under the atmosphere of the relative humidity of 80% at 35 ° C.

Furthermore, the contact of the photosensitive member with developers, sheets of copying paper and cleaning members in the copying machine did not cause the peeling of the resin layer and the surface protective layer.

Still furthermore, the duplication tests were repeated 350,000 times under the ordinary room atmosphere. As a result, the copied images were clear throughout the tests. In addition, even after the duplication tests were repeated 350,000 times, the thickness of the photosensitive layer was not decreased, and flows of the copied images did not occur even under the atmosphere of the temperature of 35° C. and the relative humidity of 80%. From these facts, it could be confirmed that the surface protective layer of the present invention could improve the durability of the photosensitive member without lowering the image quality.

EXAMPLE 30

Using the glow discharge decomposition equipment shown in FIG. 12, a surface protective layer was formed on a photosensitive layer. The substrate used was the one coated with the organic photosensitive layer Dd.

First, the interior pressure of the reaction tank (733) was raised to a high vacuum degree of about $10^{-6}$ Torr, and then, the first, and second regulating valves (707), and (708) were opened, thereby respectively introducing the hydrogen gas from the first tank (701), and the propylene gas from the second tank (702) into the first, and second mass flow controllers (713) and (714) under the output pressure of 1.0 Kg/cm$^2$. Then, by adjusting the graduations of the respective mass flow controllers, the flow rate of hydrogen gas was set to 50 sccm, and that of propylene gas to 20 sccm. They passed into the mixer (731), and were introduced into the reaction chamber (733) through the main pipe (732). After the respective flow rates were stabilized, the pressure control valve (745) was adjusted to control the interior pressure of the reaction chamber (733) to 0.5 Torr. The substrate (752) was coated with the organic photosensitive layer Dd.

The cylindrical substrate (752) was previously covered with 6,6-nylon stretchable mesh. The shape of the mesh was the same as that shown in FIG. 10, in which the pores were about 90 μm, in pore size and the intervals therebetween were about 20 μm.

Next, the substrate (752) was fixed on the grounding electrode (735) inside the reaction chamber (733). The substrate (752) was heated to 50° C. from the ordinal temperature in about 15 minutes before the introduction of the gases. With the gas flows and the pressure stabilized, the low frequency power source (741) having been connected by the connection selecting switch (744) was turned on, and applied an electric power of 150 W (frequency 80 KHz) to the power applying electrode (736), thereby causing plasma polymerization reaction for about 5 minutes. Thus, a surface protective layer constituted of the specks of an amorphous hydrocarbon layer of 0.15 μm thickness was formed on the substrate (752). The specks of width (W) of about 90 μm were distributed at about 20 μm intervals over the photosensitive layer. After forming the layer, the power application was stopped, and the regulating valves other than that for hydrogen gas were closed, thereby introducing only hydrogen gas in the flow rate of 200 sccm into the reaction chamber (733). Then, the reaction chamber (733) was cooled to about 30° C. in about 30 minutes with the pressure maintained at 10 Torr. After that, the regulating valve of hydrogen gas was closed, and the gases of the reaction chamber (733) were sufficiently exhausted to collapse the vacuum state therein. After that, the photosensitive member coated with the surface protective layer was taken out therefrom.

(Characteristics)

The pencil hardness of the photosensitive member was measured based on the JIS-K-5400 standards. As a result, it was about 6H at the portions at which the specks adhered. From this fact, it could be confirmed that the surface protective layer of the present invention could improve the hardness of the photosensitive member.

The sensitivity characteristics were almost at the same level as those of Comparative Example 4. From this fact, it could be confirmed that the surface protective layer of the present invention did not lower the original sensitivity of the organic type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the surface protective layer did not occur. From this fact, it could be confirmed that the surface protective layer of the present invention was excellent in the adhesion property with organic type photosensitive members.

The obtained photosensitive member was mounted on the copying machine (EP-650Z; made by Minolta Camera K.K. . . . ), and actual copying operations were carried out. Copied images were clear and image flows did not occur in the copied images even when actual copying operations were carried out under the atmosphere of the relative humidity of 80%.

Furthermore, the contact of the photosensitive member with developers, sheets of copying paper and cleaning members in the copying machine did not cause the peeling of the resin layer and the surface protective layer.

Still furthermore, the duplication tests were repeated 300,000 times under the ordinary room atmosphere. As a result, the copied images were clear throughout the tests. Moreover, even after the duplication tests were repeated 300,000 times, the thickness of the photosensitive layer was not decreased, and the flows of the copied images did not occur even under the atmosphere of the temperature of 35° C. and the relative humidity of 80%. From these facts, it could be confirmed that the surface protective layer of the present invention could improve the durability of photosensitive member without lowering the image quality.

EXAMPLE 31

Using the glow discharge decomposition equipment shown in FIG. 12, a surface protective layer was formed on a photosensitive layer. The substrate used was the one coated with the organic photosensitive layer Bd.

First, the interior pressure of the reaction tank (733) was raised to a high vacuum degree of about $10^{-6}$ Torr, and then, the first, second, and third regulating valves (707), (708), and (709) were opened, thereby respectively introducing the hydrogen gas from the first tank (701), the butadiene gas from the second tank (702), and the tetrafluoromethane gas from the third tank (703) into the first, second, and third mass flow controllers (713), (714), and (715) under the output pressure of 1.0 $Kg/cm^2$. Then, by adjusting the graduations of the respective mass flow controllers, the flow rate of hydrogen gas was set to 300 sccm, that of butadiene gas to 15 sccm, and that of tetrafluoromethane gas to 90 sccm. They passed into the mixer (731), and were introduced into the reaction chamber (733) through the main pipe (732). After the respective flow rates were stabilized, the pressure control valve (745) was adjusted to control the interior pressure of the reaction chamber (733) to 0.5 Torr. The substrate (752) was the one coated with the organic type photosensitive layer Bd.

The cylindrical substrate (752) was previously covered with a heat-shrinkable polyvinyl chloride mesh of about 90 mm diameter and about 300 mm length. The substrate (752) was subjected to a hot air treatment in a hot air oven to heat-shrink the same at 50° C. to adhere to the substrate (752). The shape of the mesh was the same as that shown in FIG. 7, in which the pores were about 70 μm in pore size and the interval therebetween was about 15 μm.

Next, the substrate (752) was fixed on the grounding electrode (735) inside the reaction chamber (733). The substrate (752) was heated to 50° C. from the ordinal temperature in about 15 minutes before the introduction of the gases. With the gas flows and the pressure stabilized, the low frequency power source (741) having been connected by the connection selecting switch (744) was turned on, and applied an electric power of 100 W (frequency 100 KHz) to the power applying electrode (736), thereby causing plasma polymerization reaction for about 3 minutes. Thus, a surface protective layer constituted of specks of an amorphous hydrocarbon layer of 0.2 μm thickness was formed on the substrate (752). The specks having the width (W) of about 70 μm were distributed at about 15 μm intervals over the photosensitive layer. After forming the layer, the power application was stopped, and the regulating valves other than that for hydrogen gas were closed, thereby introducing only hydrogen gas in the flow rate of 200 sccm into the reaction chamber (733). Then, the reaction chamber (733) was cooled to about 30° C. in about 30 minutes with the pressure maintained at 10 Torr. After that, the regulating valve (707) of hydrogen gas was closed, so that the gases of the reaction chamber (733) were sufficiently exhausted to collapse the vacuum state therein. After that, the photosensitive member with the surface protective layer was taken out therefrom.

(Characteristics)

The pencil hardness of the photosensitive member was measured based on the JIS-K-5400 standards. As a result, it was about 6H at the portions at which the specks were adhered. From this fact, it could be confirmed that the surface protective layer of the present invention could improve the hardness of the photosensitive member.

The sensitivity characteristics were almost at the same level as those of Comparative Example 2. From this fact, it could be confirmed that the surface protective layer of the present invention did not lower the original sensitivity of the organic type photosensitive member.

Moreover, this photosensitive member was left for 6 hours in such an environment where a low temperature and low humidity atmosphere (the temperature of 10° C. and the relative humidity of 30%) and a high temperature and high humidity atomosphere (the temperature of 50° C. and the relative humidity of 90%) were alternated at 30-minute intervals. As a result, the peeling or cracks of the surface protective layer did not occur. From this fact, it could be confirmed that the surface protective layer of the present invention were excellent in the adhesion property with organic type photosensitive members.

The obtained photosensitive member was mounted on the copying machine (EP-650Z; made by Minolta Camera K.K. . . . ), and actual copying operations were carried out. The copied images were clear and flows did not occur in the copied images even when actual copying operations were carried out under the atmosphere of the relative humidity of 80% at 35 ° C.

Furthermore, the contact of the photosensitive member with developers, sheets of copying paper and cleaning members in the copying machine did not cause the peeling of the resin layer and the surface protective layer.

Still furthermore, the duplication tests were repeated 300,000 times under the ordinary room atmosphere. As a result, the copied images were clear throughout the tests. Moreover, even after the duplication tests were repeated 300,000 times, the thickness of the photosensitive layer was not decreased, and the flows of the copied images did not occur eve under the atmosphere of the temperature of 35° C. and the relative humidity of 80%. From these facts, it could be confirmed that the surface protective layer of the present invention could improve the durability of photosensitive member without lowering the image quality.

EXAMPLE 32

Using the glow discharge decomposition equipment shown in FIG. 12, a surface protective layer was formed on a photosensitive layer. The substrate used was the one coated with the organic photosensitive layer Ed.

First, the interior pressure of the reaction tank (733) was raised to a high vacuum degree of about $10^{-6}$ Torr, and then, the first, and second regulating valves (707), and (708) were opened, thereby respectively introducing the hydrogen gas from the first tank (701), and the butadiene gas from the second tank (702) into the first, and second mass flow controllers (713) and (714) under the output pressure of 1.0 Kg/cm$^2$. Then, by adjusting the graduations of the respective mass flow controllers, the flow rate of hydrogen gas was set to 300 sccm, and that of butadiene gas to 15 sccm. They passed into the mixer (731), and were introduced into the reaction chamber (733) through the main pipe (732). After the respective flow rates were stabilized, the pressure control valve (745) was adjusted to control the interior pressure of the reaction chamber (733) to 0.22 Torr.

The substrate (752) was previously covered with a tubular heat-shrinkable polyvinyl chloride mesh of about 90 mm diameter and about 300 mm length. The substrate (752) was subjected to a hot air treatment in a hot air oven to heat-shrink the mesh at 50° C. to adhere to the substrate (752). The shape of the mesh was the same as that in FIG. 7, in which the pores were about 100 μm in pore size and the interval therebetween was about 25 μm.

Next, the substrate (752) was fixed on the grounding electrode (735) inside the reaction chamber (733). The substrate (752) was heated to 50° C. from the ordinal temperature in about 15 minutes before the introduction of the gases. With the gas flows and the pressure stabilized, the low frequency power source (741) having been connected by the connection selecting switch (744) was turned on, and applied an electric power of 100 W (frequency 80 KHz) to the power applying electrode (736), thereby causing plasma polymerization reaction for about 8 minutes. Thus, a surface protective layer constituted of the specks of an amorphous hydrocarbon layer of 0.2 μm thickness was formed on the substrate (752). The specks of about 100 μm diameter were distributed at about 25 μm intervals. After forming the layer, the power application was stopped, and the regulating valves other than that of hydrogen gas were closed, thereby introducing only hydrogen gas in the flow rate of 200 sccm into the reaction chamber (733). Then, the reaction chamber (733) was cooled to about 30° C. in about 30 minutes with the pressure maintained at 10 Torr. After that, the regulating valve (707) of hydrogen gas was closed, and the gases of the reaction chamber (733) were sufficiently exhausted to collapse the vacuum state therein. After that, the photosensitive member with the surface protective layer was taken out therefrom.

(Characteristics)

The pencil hardness of the photosensitive member was measured based on the JIS-K-5400 standards. As a result, it was about 9H or more at the portions at which specks were adhered. From this fact, it could be confirmed that the surface protective layer of the present invention could improve the hardness of the photosensitive member.

The sensitivity characteristics were almost at the same level as those of Comparative Example 5. From this fact, it could be confirmed that the surface protective layer of the present invention did not lower the original sensitivity of the organic type photosensitive member.

Moreover, this photosensitive member was left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the surface protective layer did not occur. From this fact, it could be confirmed that the surface protective layer of the present invention was excellent in the adhesion property to organic type photosensitive members.

The obtained photosensitive member was mounted on the copying machine (EP-650Z; made by Minolta Camera K.K. . . . ), and actual copying operations were carried out. The copied images were clear well defined, and flows did not occur in the copied images even when actual copying operations were carried out under the atmosphere of the relative humidity of 80% at 35 ° C.

Furthermore, the contact of the photosensitive member with developers, sheets of copying paper and cleaning members in the copying machine did not cause the peeling of the resin layer and the surface protective layer.

Still furthermore, the duplication tests were repeated 350,000 times under the ordinary room atmosphere. As a result, the copied images were clear throughout the tests. Moreover, even after the duplication tests were repeated 350,000 times, the thickness of the photosensitive layer was not decreased, and the flows of the copied images did not occur even under the atmosphere of the temperature of 35° C. and the relative humidity of 80% From these facts, it could be confirmed that the surface protective layer of the present invention could improve the durability of photosensitive member without lowering the image quality.

Comparative Examples 17 and 18

Using a substrate (752) which was not covered with a mesh or other mask, a uniform surface protective layer of amorphous hydrocarbon was formed over the entire surface thereof. Other producing procedures were the same as those of Example 30 (Comparative Example 17), and of Example 31 (Comparative Example 18).

(Characteristics)

The pencil hardness of the obtained photosensitive members was measured based on the JIS-K-5400 standards. As a result, Comparative Examples 17 and 18 showed the hardness of about 6H respectively. From this fact, it could be confirmed that the surface protective layer of the present invention could improve the hardness of the photosensitive member.

The sensitivity characteristics were almost at the same levels as those of Comparative Examples 1 and 5. From this fact, it could be confirmed that the surface protective layers obtained in Comparative Examples 17 and 18 did not lower the original sensitivities of the organic type photosensitive members.

Moreover, these photosensitive members were respectively left for 6 hours in such an environment where a low temperature and low humidity atmosphere (the temperature of 10° C. and the relative humidity of 30%) and a high temperature and high humidity atmosphere (the temperature of 50° C. and the relative humidity of 90%) were alternated at 30-minute intervals. As a result, the peeling or cracks of the surface protective layers did not occur. From this fact, it could be confirmed that the surface protective layers obtained in Comparative Examples 17 and 18 were excellent in the adhesion properties to organic type photosensitive members.

These photosensitive members were respectively mounted on the copying machine (EP-650Z; made by Minolta Camera K.K. . . . ) and actual copying operations were carried out. The resultant copied images were clear in any case of Comparative Examples 17 and 18. In addition, in both of the cases, flows did not occur in the copied images even when actual copying operations were carried out under the atmosphere of the temperature of 35° C., and of the relative humidity of 80%.

Furthermore, the contact of the photosensitive member with developers, sheets of copying paper and cleaning members in the copying machine did not cause the peeling of the resin layer and the surface protective layer.

Still furthermore, the duplication tests were repeated 250,000 times under the ordinary room atmosphere. As a result, the copied images were clear throughout the tests in both of the cases. In addition, the thickness of the photosensitive layers were not decreased. It is, however, noted that in the case of Comparative Example 17, the flows of copied images were observed under the temperature of 35° C. and the relative humidity of 80% after copying operations were repeated 150,000 times under the ordinary atmosphere, and in the case of Example 18, the flows were observed in the copied images under the temperature of 35° C. and the relative humidity of 80% after the copying operations were repeated 100,000 times under the ordinary atmosphere. From these facts, it could be confirmed that the surface protective layers of the present invention, which consist of the specks distributed over photosensitive layers, were more excellent in the durability with respect to image qualities a well.

What is claimed is:

1. A photosensitive member for retaining electrostatic latent images, which comprises:

an electrically conductive substrate, a photosensitive layer formed on the electrically conductive substrate and including a photoconductive material, and electrically insulating and light-transmittable specks comprising inorganic material and distributed on the photosensitive layer as a surface protective layer, the maximal width (W) of each speck if 200 μm or less, and the ratio L/W of the distance (L) between each of the specks to the maximal width (W) is 1 or less.

2. A photosensitive member of claim 1, wherein the nearest distance (L) between each of the specks adjacent to each other is 200 μm or less.

3. A photosensitive member of claim 1, wherein the thickness of the surface protective layer composed of the distributed specks is 0.01 to 5 μm.

4. A photosensitive member of claim 1, wherein the speck has an electrical resistance of $10^{10}$ Ω.cm or more.

5. A photosensitive member for retaining electrostatic latent images, which comprises:

an electrically conductive substrate, a photosensitive layer formed on the electrically conductive substrate and including a photoconductive material, and electrically insulating and light-transmittable specks comprising amorphous hydrocarbon and distributed on the photosensitive layer as a surface protective layer, the maximal width (W) of each speck being 200 μm or less, and the ratio L/W of the distance (L) between each of the specks to the maximal width (W) being 1 or less.

6. A photosensitive member of claim 5, wherein the amorphous hydrocarbon contains halogen atoms.

7. A photosensitive member of claim 5, wherein the amorphous hydrocarbon contains hydrogen atoms at a content of 5–50 atomic % on the basis of the number of all atoms forming the amorphous hydrocarbon.

8. A photosensitive member of claim 5, wherein the amorphous hydrocarbon contains the elements of the group III or v of the periodic table.

9. A photosensitive member of claim 1, wherein the specks comprises a metallic compound selected from the group consisting of metallic oxides, metallic nitrides, metallic fluorides, metallic carbides and metallic sulfides.

10. A photosensitive member of claim 1, wherein the specks comprises amorphous silicon.

11. A photosensitive member of claim 10, wherein the amorphous silicon comprises carbon atoms.

12. A photosensitive member of claim 1, wherein the photosensitive layer comprises a photoconductive material dispersed in a binder resin.

13. A photosensitive member of claim 12, wherein the photoconductive material is an organic photoconductive compound.

14. A photosensitive member of claim 1, wherein the photosensitive layer comprises a charge generating layer and a charge transporting layer.

15. A photosensitive member of claim 1, wherein the photosensitive layer is a selenium type photosensitive layer.

16. A photosensitive member of claim 1, wherein the photosensitive layer is an amorphous silicon type photosensitive layer.

17. A photosensitive member for retaining electrostatic latent images, which comprises:

an electrically conductive substrate, a photosensitive layer formed on the electrically conductive substrate and including a photoconductive material, a resinous layer formed on the photosensitive layer, which is composed of a resin as a main component, and electrically insulating and light-transmittable specks comprising inorganic material and distributed on the resinous layer as a surface protective layer, the maximal width (W) of each speck is 200 μm or less, and the ratio L/W of the distance (L) between the maximal width (W) is 1 or less.

18. A photosensitive member of claim 17, wherein the nearest distance (L) between each of the specks adjacent to each other is 200 μm or less.

19. A photosensitive member of claim 17, wherein the thickness of the surface protective layer composed of the distributed specks is 0.01 to 5 μm.

20. A photosensitive member of claim 17, wherein the speck has an electrical resistance of $10^{10}$ Ω.cm or more.

21. A photosensitive member of claim 17, wherein the speck comprises amorphous hydrocarbon.

22. A photosensitive member of claim 17, wherein the speck comprises a metallic compound selected from the group consisting of metallic oxides, metallic nitrides, metallic fluorides, metallic carbides and metallic sulfides.

23. A photosensitive member of claim 17, wherein the speck comprises amorphous silicon.

24. A photosensitive member of claim 17, wherein the thickness of the resinous layer is 0.01 to 5 μm.

25. A photosensitive member of claim 17, wherein the resinous layer comprises an electrically conductive metallic compound.

26. A photosensitive member of claim 17, wherein the photosensitive layer comprises a photoconductive material dispersed in a binder resin.

27. A photosensitive member of claim 26, wherein the photoconductive material is an organic photoconductive compound.

28. A photosensitive member of claim 17, wherein the photosensitive layer comprises a charge generating layer and a charge transporting layer.

29. A photosensitive member of claim 17, wherein the photosensitive layer is a selenium type photosensitive layer.

30. A photosensitive member of claim 17, wherein the photosensitive layer is an amorphous silicon type photosensitive layer.

* * * * *